US007773048B2

(12) United States Patent
Shiraishi

(10) Patent No.: US 7,773,048 B2
(45) Date of Patent: Aug. 10, 2010

(54) DISPLAY APPARATUS AND DRIVING METHOD THEREOF AND DISPLAY CONTROLLER DEVICE

(75) Inventor: Tai Shiraishi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1300 days.

(21) Appl. No.: 11/177,300

(22) Filed: Jul. 11, 2005

(65) Prior Publication Data

US 2006/0007114 A1 Jan. 12, 2006

(30) Foreign Application Priority Data

Jul. 12, 2004 (JP) ..... 2004-205223
May 24, 2005 (JP) ..... 2005-151626

(51) Int. Cl.
*G09G 5/00* (2006.01)

(52) U.S. Cl. ..... 345/1.1; 345/1.2; 345/98; 345/103

(58) Field of Classification Search ..... 345/98, 345/100, 103, 204, 698, 1.1–3.1
See application file for complete search history.

(56) References Cited

U.S. PATENT DOCUMENTS

| | | | | |
|---|---|---|---|---|
| 5,771,031 | A | 6/1998 | Kinoshita et al. | |
| 6,583,771 | B1 * | 6/2003 | Furuhashi et al. | 345/1.1 |
| 6,825,845 | B2 * | 11/2004 | Nally | 345/545 |
| 6,867,759 | B1 * | 3/2005 | Baek et al. | 345/99 |
| 2001/0002124 | A1 * | 5/2001 | Mamiya et al. | 345/132 |
| 2003/0112204 | A1 * | 6/2003 | Pettersen | 345/1.1 |
| 2003/0214473 | A1 | 11/2003 | Lee | |
| 2004/0008155 | A1 * | 1/2004 | Cok | 345/1.3 |
| 2006/0262070 | A1 | 11/2006 | Lee | |
| 2007/0171229 | A1 | 7/2007 | Mamiya et al. | |

FOREIGN PATENT DOCUMENTS

| | | |
|---|---|---|
| JP | 08-211846 | 8/1996 |
| JP | 10-105131 | 4/1998 |
| JP | 10-312175 | 11/1998 |
| JP | 2000-322044 | 11/2000 |
| JP | 2000-330536 | 11/2000 |
| JP | 2001-166761 A | 6/2001 |
| JP | 2001-350458 A | 12/2001 |
| JP | 2003-216134 A | 7/2003 |
| JP | 2003-330435 | 11/2003 |

* cited by examiner

*Primary Examiner*—Amr Awad
*Assistant Examiner*—Stephen A Bray
(74) *Attorney, Agent, or Firm*—Harness, Dickey & Pierce, P.L.C.

(57) ABSTRACT

Plural controller circuits capable of mutually exchanging data are used as a display controller, the plural controller circuits connected to each other via a data bus. Each of the controller circuits, which receives image data, (i) transfers image data other than image data of a screen region, driving of which the controller circuit is in charge of controlling, on the other hand, (ii) stores, into a line memory section thereof, the image data of the screen region, driving of which the controller circuit is in charge of controlling together with image data that is transferred from another controller and that is for the screen region, driving of which the controller circuit is in charge of controlling, and converts the thus stored image data into output image data. This makes it possible to establish common use of a display controller for different resolutions so as to provide cost merit.

31 Claims, 15 Drawing Sheets

Prior Art

DISPLAY APPARATUS AND DRIVING METHOD THEREOF AND DISPLAY CONTROLLER DEVICE

This Nonprovisional application claims priority under 35 U.S.C. §119(a) on Patent Applications No. 205223/2004 and No. 151626/2005 respectively filed in Japan on Jul. 12, 2004 and on May 24, 2005, the entire contents of which are hereby incorporated by reference.

FIELD OF THE INVENTION

The present invention relates to a display apparatus and a driving method thereof, and a display controller device; the display apparatus provided with (a) plural signal lines, (b) plural scanning lines, (c) a picture element corresponding to each of intersections of the signal lines and the scanning lines.

BACKGROUND OF THE INVENTION

In recent years, flat-panel display apparatuses whose typical example is a liquid crystal display apparatus (LCD) are widely used in devices, such as a personal computer, a television (TV) and the like, which have display screens. Flat-panel display apparatuses generally have thin thickness, light weights, and low energy consumptions. Among the flat panel display apparatuses, research and development of an active matrix LCD is actively performed because the active matrix LCD can provide an excellent display image, which is not disturbed by a crosstalk between adjacent picture elements.

Generally an active matrix LCD 211, as illustrated in FIG. 6, includes a display panel 212, a signal line driving circuit 214, and a scanning line driving circuit 213. The display panel 212 is provided with (i) plural signal lines SL (SL1 . . . SLn), (ii) plural source lines GL (GL1 . . . GLm), and (iii) a plural number of picture elements 216. The signal line driving circuit 214 is for driving the plural signal lines SL, and the scanning line driving circuit 213 is for driving the plural scanning lines GL.

The signal line driving circuit 214 converts, to a parallel format, image data DT supplied sequentially from outside at every horizontal scanning period. The image for one horizontal picture element array attained by the conversion mentioned above is converted into an analog voltage. Then, the analog voltage is supplied to each of the signal lines SL. The scanning line driving circuit 213 supplies a selection signal voltage so that the plural scanning lines GL are selected sequentially one by one or some at a time during one vertical period.

With reference to FIG. 15, the image data DT is explained as follows. The image data DT is supplied in a form of a video signal under NTSC or the like from an outside tuner 150, a DVD apparatus 151, a VTR apparatus 152 or the like. After the image data DT is converted, by a video source 153, into image data DT and display controlling signals including a clock signal CLK, a synchronized signal SYCN and the like, the image data DT is supplied to the signal line driving circuit 214 of an active matrix LCD 211 through a display controller 215 illustrated in FIG. 6. In FIG. 15, the signal line driving circuit 214 is not illustrated.

The display controller 215 controls the signal line driving circuit 214 and the scanning line driving circuit 213. The display controller 215 supplies the image data DT, a source synchronized signal SSP, and a source clock signal SCK to the signal line driving circuit 214. On the other hand, the display controller 215 supplies a gate synchronized signal GSP and a gate clock signal GCK to the scanning line driving circuit 213. In general, some line memories are provided in the display controller 215. The line memories are used for converting a format of the image data DT from an input format to an output format.

Conventionally, no common use of one type of display controller, i.e. integration of the display controllers has been established which allows one type of display controller to be commonly used for every resolution of display apparatuses (e.g. active matrix LCDs): Display controllers like the display controllers mentioned above have been developed individually according to resolutions of the display apparatuses to which the display controllers are to be provided. This is mainly because the line memory needs different memory capacities depending on the resolutions.

To explain with a specific example, in a case of a display controller for an XGA (extended Graphics Array) (1024×768) display controller, a 1024-word line memory can be used. On the contrary, in a case of a display controller for an HDTV (High Definition Television) (1920×1080), the necessary line memory is a 1920-word line memory, which has substantially two times line memory capacity compared with the line memory used for the display controller for XGA. The display controller is made of an LSI (Large Scale Integration). Because the line memory occupies a large part of a circuit space of the LSI, cost (chip size) of the LSI is determined by the memory capacity of the line memory provided in the display controller.

Accordingly, even if common use of a display controller for every resolution that differ from each other to a large extent is established, there is no cost merit by the common use of the display controller. This is because the display controller for common use should have the memory capacity for the maximum resolution. As the result, at present, the display controllers are developed individually for every resolution and no common use of one type of display controller has been actually developed.

Meanwhile, Japanese Laid-Open Patent Application 211846/1996 (Tokukaihei 8-211846, published on Aug. 20, 1996) discloses a method for reducing the line memory capacity. This method relates to a block driving technique for high resolution display apparatus. In the block driving technique, each horizontal pixel array is divided into N picture element blocks (N is a whole number equal to or larger than 2), and is driven per block. Under the block driving technique, this method is arranged such that data for two pixel elements is inputted and outputted into/from pixel memories at a time, and a picture screen is driven in such a manner that every two source driver units adjacent to each other drives the pixel elements. When this method is applied to the display controller for high resolution display apparatus, reduction in the necessary line memory capacity is possible. As the result, the display controller for the high resolution display apparatus can be used as a display controller for low resolution display apparatus.

However, the technique disclosed in Japanese Laid-Open Patent Application 211846/1996 is arranged such that a data bus is connected to the adjacent source drivers. Accordingly, the application of the technique is limited to a case in which there is one source substrate forming the source driver. The technique is not applicable to a case of a large display panel having plural source substrates, for example, as described in Japanese Laid-Open Patent Application 105131/1998 (Tokukaihei 10-105131, published on Apr. 24, 1998).

With reference to FIGS. 7 through 10, a conventional display apparatus (an active matrix LCD) including a display panel that has plural source substrates is explained. Illustration in figures and explanations of the scanning line driving circuit are omitted for convenience.

A display apparatus using an XGA panel 116 is illustrated in FIG. 7. The display apparatus includes the XGA panel 116, a signal line driving circuit 114, and a display controller 110. The signal line driving circuit 114 drives plural signal lines (not illustrated) of the XGA panel 116. The signal line driving circuit 114 includes respective source substrates 115L and 115R for a left screen and a right screen. The source substrate 115L includes four source drivers SD1 to SD4 and the source substrate 115R includes four source drivers SD5 to SD8.

A display controller 110 includes one input route and two output routes. The image data is inputted sequentially. The input starts from the image data for the left end of the screen on the XGA panel 116. On the other hand, the image data of the left screen 117L and the image data of the right screen 117R are outputted at the same time. In order to rearrange this output image data, the display controller 110 includes a first line memory 112 and a second line memory 113 for two lines. The first line memory 112 and the second line memory 113 are 1024-word line memories for use in the XGA. Moreover, the display controller includes a controller section 110, which is not illustrated. The controller section controls operation of each section in the display controller 110.

FIG. 8 is a timing chart of the display apparatus using the XGA panel 116. In the display controller 110, the image data (in the FIG., IN_DT) DT1, DT2, DT3, . . . , DT1024 inputted through an input section 111 are stored sequentially in order from the image data DT1. The storage into the first line memory 112 is carried out from the left end of the first line memory 112. At the same time, previous-line image data (in the FIG., O_DT_L, O_DE_R) DT1, DT2, DT3, . . . , DT1024 (image data of a previous line) are read sequentially from the left side of the second line memory 113, the image data having been already stored in the second line memory 113. The reading starts from data for a left end of the screen and data for a center of the screen. The signal indicated by DE in the FIG. is a display enabling signal indicating a valid data period for one line. Both of the display enabling signal DE and the clock signal CLK are inputted together with the image data DT through the input section 111.

The image data DT1 for the left end of the screen is first data to be written into the left screen 117L. The image data DT1, DT2, DT3, . . . , DT512 are read sequentially from the image data DT1 for the left end of the screen. The read image data are inputted into four source drivers SD1 to SD4 for driving the left screen 117L, starting from the source driver SD1 located leftmost.

On the other hand, the image data DT 513 for the center of the screen is first image data to be written into the right screen 117R. The image data DT513, DT514, DT515, . . . , DT1024 are read sequentially from the image data DT513 for the center of the screen. The read image data are inputted into four source drivers SD5 to SD8 for driving the right screen 117R in order from the source driver SD5 located leftmost.

An output frequency is a half of an input frequency. Accordingly, when it has been completed to store the image data DT1, DT2, DT3, . . . , DT1024 for one line into, for example, the first line memory 112, the second line memory 113, which is the counter part of the first line memory 112, has been emptied by then. Into this empty second line memory 113, the image data DT1, DT2, DT3, . . . , DT1024 for the next one line are stored sequentially in the same way. At the same time, the image data DT1, DT2, DT3, . . . , DT512 and the image data DT513, DT514, DT515, . . . , DT1024 are read by two routes from the first line memory 112 in the same way as mentioned above.

In this way, the image data writing and reading for every line in order are alternately performed respectively by using the first line memory 112 and the second line memory 113.

FIG. 9 illustrates a display apparatus using a HDTV panel 126. The display includes the HDTV panel 126, a signal line driving circuit 124, and a display controller 120. The signal line driving circuit 124 drives plural signal lines (riot illustrated) of the HDTV panel 126. The signal line driving circuit 124 includes source substrates 125L and 125R respectively for the left screen and the right screen. The source substrate 125L includes seven source drivers SD1 to SD7 and the source substrate 125R includes seven source drivers SD8 to SD14.

The display controller 120 includes two input routes and two output routes. The image data of odd numbered picture element (herein, denoted as "odd image data") and the image data of even numbered picture element (herein, denoted as "even image data") are inputted into the HDTV panel 126 at the same time. The input starts from the left end of the screen. On the other hand, the image data on the left screen 127L and the right screen 127R are outputted at the same time. In this case again, in order to rearrange the output image data, a first line memory 122 and a second line memory 123 for two lines are provided. These first line memory 122 and the second line memory 123 are the 1920-word line memories for use in the HDTV. In the case of the HDTV, each of the first line memory 122 and the second line memory 123 is made of two 960-word memories, which are a memory for odd number and a memory for even number, because the odd image data and the even image data are inputted at the same time. The 960-word memories of the first and the second line memories 122 and 123 are memory regions independently controllable.

FIG. 10 is a timing chart of a display apparatus using the HDTV panel 126. The odd image data (in FIG., IN_DT_O) DT1, DT3, DT5, . . . , DT1919 and the even image data (in FIG., IN_DT_E) DT2, DT4, DT6, . . . , DT1920 are inputted into the display controller 120 at the same time through the input section 121. The odd image data and the even image data are sequentially stored into the memory for odd number and the memory for even number in the first line memory 122, from the left side of the odd and even memories. The storing of the image data is performed at timing of the clock signal CLK in such a manner that the image data DT1 and DT2, DT3 and DT4, . . . are inputted respectively in to the odd and even memories in this order. At the same time, the previous-line image data (in FIG., O_DT_L, O_DE_R) DT1, DT2, DT3, . . . , DT1920 are read sequentially from the left end of the second line memory 123, the image data having been already stored in the second line memory 123. The reading starts from data for the left end of the screen and data for the center of the screen at the same time.

The image data DT1 for the left end of the screen is the first image data to be written into the left screen 127L. The reading of the image data is carried out from the memory for odd number and the memory for even number alternately. The image data DT1, DT2, DT3, . . . , DT960 are read sequentially, starting from the image data DT1 from the left end of the screen. The read image data are inputted into seven source drivers SD1 to SD7 in order from the source driver SD1 located leftmost.

On the other hand, the image data DT961 for the center of the screen is the first image data to be written into the right screen 127R. The image data DT961, DT962, DT963, . . . , DT1920 read in order form the image data DT961 for the center of the screen are inputted into seven source drivers SD8 to SD14 for driving the right screen 127R in order from the source driver SD8 located leftmost.

The output frequency in this case is also a half of the input frequency. When it has been completed to store the image data DT1, DT2, DT3, . . . , DT1920 for one line into the first line memory 122, the second line memory 123 has been emptied by then. The image data DT1, DT2, DT3, . . . , DT1920 of the next line are stored sequentially into this empty second line memory in the same manner. At the same time, the image data DT1, DT2, DT3, . . . , DT960 and the image data DT 961, DT962, DT963, . . . , DT1920 are read by two routes from the first line memory 122 in the same manner mentioned above.

In this way, in the same way as in the case of the XGA, the controller section (not illustrated) performs the data conversion process for every line by alternatively reading and storing data respectively from/into the first line memory 122 and the second line memory 123.

However, to develop display controllers for respective resolutions, a large effort and high development cost are required. The development also causes the increase in number of part variations, thereby resulting into increase in management cost, deconcentration of quantity of the display controllers into various types of the display controllers in production of the display apparatus, and the other problems. This results in becoming obstacles to cost reduction. Because of inconvenience caused by the problems mentioned above, there has been still a demand for integration of the display controllers (that is, to establish the common use of one type of the display controller) so that the development of the display controllers for respective resolutions becomes unnecessary.

One method for integrating the display controllers, i.e., developing common use of one type of the display controller device is employing, in the XGA panel 116 for low resolution, the display controller (for HDTV) 120 for high resolution, as illustrated in FIG. 11. However, as mentioned before, there is no cost merit in the integration employing an expensive display controller for high resolution in a low resolution display apparatus.

Moreover, on the contrary to the method mentioned above, the integration, at a first glance, seems possible by using two display controllers (for the XGA) 110 for low resolution in the HDTV panel 126 for high resolution, as illustrated in FIG. 12. However, this cannot be realized for the following reason. That is, although only either odd image data or even image data can be inputted into each of the display controllers 110 for the low resolution, both of the odd image data and the even image data for each screen (the left screen and the right screen) need to be outputted from each of the display controllers 110. However, the display controllers 110 cannot convert the image data into desired output image data because the display controllers 110 are mutually independent and do not have a mechanism to exchange data each other.

SUMMARY OF THE INVENTION

An object of the present invention is to provide a display apparatus and a driving method thereof, and a display controller device, by each of which it is possible (i) to establish common use of a display controller for different resolutions so as to have cost merit and (ii) to reduce cost accordingly.

A display apparatus driving method of the present invention is a method, in which (i) N sets of image data respectively for N pixels are inputted at a time respectively via N routes (N is a whole number equal to or more than two), (ii) the N sets of image data are converted, by a display controller, to N sets of image data respectively for N screens, where a whole screen is divided into the N screens horizontally, and (iii) the N sets of image data is outputted to a display driving section via N×k routes (k is a whole number equal to or more than one). In order to solve the problem mentioned above, the display apparatus driving method of the present invention is arranged such that the display controller includes N controller circuits connected to each other via a data bus or data buses and respectively including a line memory, wherein the N sets of image data are inputted into the N controller circuits respectively via N routes. In order to solve the problem mentioned above, the display apparatus driving method of the present invention is further arranged such that each of the N controller circuits (i) transfers a transfer portion of the thus inputted image data via the data bus or data buses to another one of the N controller circuits that is in charge of controlling driving of a screen that the transfer portion is for, (ii) stores a stay portion of the thus received image data in its own line memory together with a transfer portion that (a) is for the screen, driving of which that one of the N controller circuits is in charge of controlling and that (b) is transferred to that one of the N controller circuits, and (iii) converts, into output image data, the stay portion and transfer portion thus stored in its own line memory, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling. It is preferable that each of the N controller circuits include an identical semiconductor chip.

In this method, (i) the display controller is provided with the N controller circuits, the display controller arranged such that the N sets of image data respectively for N pixels are inputted at a time respectively via N routes (N is a whole number equal to or more than two), (ii) the N sets of image data are converted, by the display controller, to the N sets of image data respectively for N screens, where the whole screen is divided into the N screens horizontally, and (iii) the N sets of image data is outputted to the display driving section via N×k routes (k is a whole number equal to or more than one). This method is arranged such that the image data respectively inputted into the respective controller circuits are mutually exchanged between the controller circuits. This makes it possible for each of the controller circuits to supply necessary image data to a driving display section for the screen, driving of which that controller circuit is in charge of controlling.

In this driving method, a memory capacity of the line memory provided in each of the controller circuits can be reduced to 1/N of the memory capacity necessary when the display controller is made of one controller circuit.

In the HDTV (1920×1080) display controller, as mentioned above, a memory capacity of the memory conventionally needs substantially two times a capacity of a memory for the XGA (1024×768). However, the driving method having the arrangement according to the present invention makes it possible to commonly use one type of display controller devices (such as LSI or the like) which constitutes one controller circuit, for low resolution (such as a case of XGA) and for high resolution (such as a case of HDTV). Namely, according to this arrangement, for low-resolution XGA the display control can be carried out by using one of the display controller devices of one type and for high-resolution HDTV, the display control can be carried out by using two of the display controller devices of one type.

Namely, according to the driving method mentioned above, the display controller device constituting the low resolution display controller can be used as the high resolution display controller. Therefore, it becomes possible to establish integration of display controllers for different resolutions, i.e.

common use of a display controllers for different resolutions. The common use is advantageous costwise. Moreover, reducing price of the display apparatus can be realized.

Moreover, another display apparatus driving method of the present invention is a method, in which (i) one set of image data for one pixel is inputted at a time via one route, (ii) the one set of image data is converted, by a display controller, to N sets of image data respectively for N screens, where a whole screen is divided into the N screens horizontally, and (iii) the N sets of image data is outputted to a display driving section via N×k routes (N is a whole number equal to or more than two and k is a whole number equal to or more than one). In order to solve the problem mentioned above, the display apparatus driving method of the present invention is arranged such that the display controller includes N controller circuits connected to each other via a data bus or data buses and respectively including a line memory, wherein the N sets of image data are inputted into only one of the N controller circuits. In order to solve the problem mentioned above, the display apparatus driving method of the present invention is further arranged such that the one of the N controller circuit (i) stores a stay portion of the thus inputted image data into the line memory thereof and converts the stay portion to an output image data, and (ii) transfers, via the data bus or data buses, a transfer portion of the thus inputted image data to another one of the N controller circuits which is in charge of controlling driving of a screen that the transfer portion is for, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling. Moreover, in order to solve the problem mentioned above, the display apparatus driving method of the present invention is further arranged such that each of the N controller circuits other than the one of the N controller circuits (i) stores, into the line memory thereof, the transfer portion transferred thereto and (ii) converts the transfer portion into output image data. It is also preferable that each of the N controller circuits include an identical semiconductor chip.

According to the another driving method mentioned above, like the driving method previously mentioned, the display controller device constituting the low resolution display controller can be used as the high resolution display controller. Therefore, it becomes possible to establish integration of display controllers for different resolutions, i.e. common use of a display controllers for different resolutions. The common use is advantageous costwise. Moreover, reducing price of the display apparatus can be realized.

Furthermore, compared with the arrangement in which the N sets of the image data for N pixels are inputted at a time via N routes, the arrangement of the another driving method is such that the frequency becomes N times the frequency of the arrangement compared. However, because the input is carried out via one route, number of pins for interface connectors and number of connecting cables are reduced to 1/N of the arrangement in which the N sets of the image data for into N pixels are inputted at a time. Accordingly, merit such as cost reduction becomes possible.

A display apparatus of the present invention is a display apparatus, in which (i) N sets of image data respectively for N pixels are inputted at a time respectively via N routes (N is a whole number equal to or more than two), (ii) the N sets of image data are converted, by a display controller, to N sets of image data respectively for N screens, where a whole screen is divided into the N screens horizontally, and (iii) the N sets of image data is outputted to a display driving section via N×k routes (k is a whole number equal to or more than one). In order to attain the object, the display apparatus of the present invention is arranged such that the display controller includes N controller circuits connected to each other via a data bus or data buses and respectively including a line memory; the display controller includes N controller circuits connected to each other via a data bus or data buses and respectively including a line memory, wherein the N sets of image data are inputted into the N controller circuits respectively via N routes; and each of the N controller circuits (i) transfers a transfer portion of the thus inputted image data via the data bus or data buses to another one of the N controller circuits that is in charge of controlling driving of a screen that the transfer portion is for, (ii) stores a stay portion of the thus received image data in its own line memory together with a transfer portion that (a) is for the screen, driving of which that one of the N controller circuits is in charge of controlling and that (b) is transferred to that one of the N controller circuits, and (iii) converts, into output image data, the stay portion and transfer portion thus stored in its own line memory, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

Another display apparatus according to the present invention is a display apparatus, in which (i) one set of image data for one pixel is inputted at a time via one route, (ii) the one set of image data is converted, by a display controller, to N sets of image data respectively for N screens, where a whole screen is divided into the N screens horizontally, and (iii) the N sets of image data is outputted to a display driving section via N×k routes (N is a whole number equal to or more than two and k is a whole number equal to or more than one). In order to attain the object the another display apparatus is arranged such that the display controller includes N controller circuits connected to each other via a data bus or data buses and respectively including a line memory; the N sets of image data are inputted into only one of the N controller circuits; the one of the N controller circuit (i) stores a stay portion of the thus inputted image data into the line memory thereof and (ii) converts the stay portion to an output image data, and (ii) transfers, via the data bus or data buses, a transfer portion of the thus inputted image data to another one of the N controller circuits which is in charge of controlling driving of a screen that the transfer portion is for, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling; and each of the N controller circuits other than the one of the N controller circuits (i) stores, into the line memory thereof, the transfer portion transferred thereto and (ii) converts the transfer portion into output image data.

As explained for the display apparatus driving methods, according to these arrangements of display apparatuses, the display controller device constituting the low resolution display controller can be used as the high resolution display controller. Therefore, it becomes possible to establish integration of display controllers for different resolutions, i.e. common use of a display controllers for different resolutions. The common use is advantageous costwise. Moreover, reducing price of the display apparatus can be realized.

In order to attain the object, a display controller device according to the present invention is arranged to include an input section for allowing image data at least to be inputted from outside; a data input-output section for allowing the image data at least to be exchanged mutually with another display controller device; first and second line memories, which have substantially same capacities, for storing the image data inputted from the input section or the data input-output section; and a controller section for controlling the input section, the data input-output section, and the first and the second line memories, the controlling section controlling the first and the second line memories in such a manner that the first and the second line memories alternatively carry out a storage operation and a reading operation of the image data for every one-line image data, the display controller device having (i) a first mode and a second mode, (ii) the first mode, a third mode, and a fourth mode, or (iii) the first mode, the second mode, the third mode, and the fourth mode. The first mode is such that under the control of the controller section, the display controller device does not transfer the image data through the data input-output section, but stores the one-line image data inputted from the input section into the first line memory or the second line memory. The second mode is such that the image data is inputted into the display controller device through the input section via predetermined one of N routes (N is a whole number equal to or more than two); the display controller device transfers, via the data input-output section, a transfer portion of the thus inputted image data to the predetermined display controller device; and under the control of the control section, the display controller device stores, into the first line memory or the second line memory, a stay portion of the thus inputted image data and a transfer portion transferred thereto from another display controller device. The third mode is such that the image data is inputted via the input section into the display controller section; under the control of the control section, the display controller device transfers, via the data input-output section, a transfer portion of the thus inputted image data to the predetermined display controller device; and under the control of the control section, the display controller device stores a stay portion of the thus inputted image data into the first line memory or the second line memory. The fourth mode is such that the image data is inputted via the input section into the display controller section; and under the control of the control section, the display controller device stores, into the first line memory or the second line memory, a transfer section transferred thereto via the data input-output section. Here, the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

By arranging the display controller device as mentioned above, the display controller device can be applied to the low resolution display controller and the high resolution display controller having an arrangement in which N sets of the image data for N pixels are inputted at a time via N routes or the image data for one pixel is inputted into at a time via one system. Accordingly, the display apparatus of the present invention and the driving method thereof can be easily realized.

For a fuller understanding of the nature and advantages of the invention, reference should be made to the ensuing detailed description taken in conjunction with the accompanying drawings.

DESCRIPTION OF THE EMBODIMENTS

Embodiment 1

An embodiment of the present invention is explained below, by referring to FIG. 1 through FIG. 5.

As mentioned above, a method, in which two display controllers for a low resolution XGA panel are used in a high resolution HDTV panel, has not been able to be realized conventionally. This is because the conventional display controllers are mutually independent and do not have a mechanism for exchanging data each other.

In order to solve the problem, according to the present invention, display controllers are arranged to be capable of exchanging data each other. This results in achieving realization of a method in which two display controllers for the low resolution XGA panel are used in the high resolution HDTV panel. This makes it possible to attain cost merit due to common use of one type of display controller (i.e. integration of the display controllers). In the embodiment here, the low resolution panel is an XGA panel and the high resolution panel is an HDTV panel by way of example.

Figure 1:
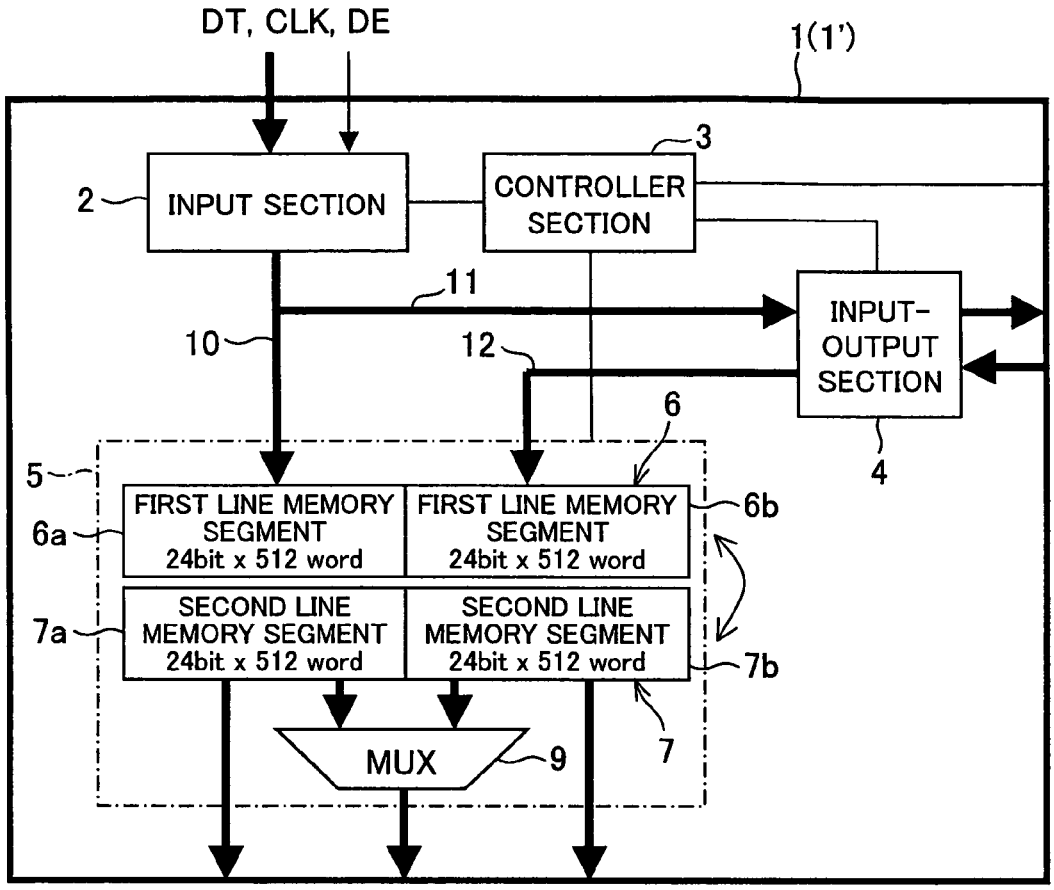
FIG. 1 is a block chart schematically illustrating an arrangement of a display controller device included in a display controller, according a first embodiment of the present invention.

FIG. 1 illustrates an arrangement of a display controller device 1 according to the embodiment of the present invention. The display controller device 1 mainly includes an input section 2, an input-output section 4, a line memory section 5, and a controller section 3.

The input section 2 is provided in the display controller device 1 receives data input from outside. A display enabling signal DE and a clock signal CLK indicating a valid data period are inputted into the input section 2 together with an image data DT. These display enabling signal DE and clock signal CLK are display controlling signals. These image data DT, the display enabling signal DE, and the clock signal CLK inputted into the input section 2 are outputted to the line memory section 5 and the input-output section 4, as indicated by the broad arrows 10 and 11. The controller section 3 controls switch-over of output destination of the signals. In the case where the display controller device 1 is used for the low resolution XGA, only the line memory section 5 becomes the output destination. On the other hand, in the case where the display controller device 1 is used for the high resolution HDTV, the line memory section 5 and the input-output section 4 become output destinations alternately at a predetermined timing as explained later.

The input-output section 4 serves both as an input section and an output section. The functions of the input-output section 4 are selectively switched under control by the controller section 3. The input-output section 4, when serving as an output section, outputs the image data DT, the display enabling signal DE, and the clock signal CLK to outside of the display controller device 1, the image data DT, the display enabling signal DE, and the clock signal CLK having been transmitted from the input section 2 to the input-output section 4. On the other hand, the input-output section 4, when serving as an input section, receives input of the image data DT, the display enabling signal DE, and the clock signal CLK inputted from outside of the display controller device 1 and, further, transmits these image data DT, the display enabling signal DE and the clock signal CLK inputted from the outside to the line memory section 5 as illustrated by the broad arrow 12.

The line memory section 5 is for converting an image data format from an input format to an output format. The line memory section 5 here includes a first line memory 6, a second line memory 7 and a multiplexer 9 which is used according to need. The first line memory 6 and the second line memory 7 are respectively 1024-word line memories for use in the low resolution XGA. The line memories 6 and 7 are respectively divided into independently controllable memory regions.

To be more specific, both of the first line memory 6 and the second line memory 7 are arranged to include two 512-word line memories as an independently controllable memory regions. The first line memory 6 is made of a first line memory segment (line memory A) 6*a* and a first line memory segment (line memory B) 6*b*. The second line memory 7 is made of the second line memory segment (line memory A) 7*a* and the second line memory (line memory B) 7*b*.

Figure 4:
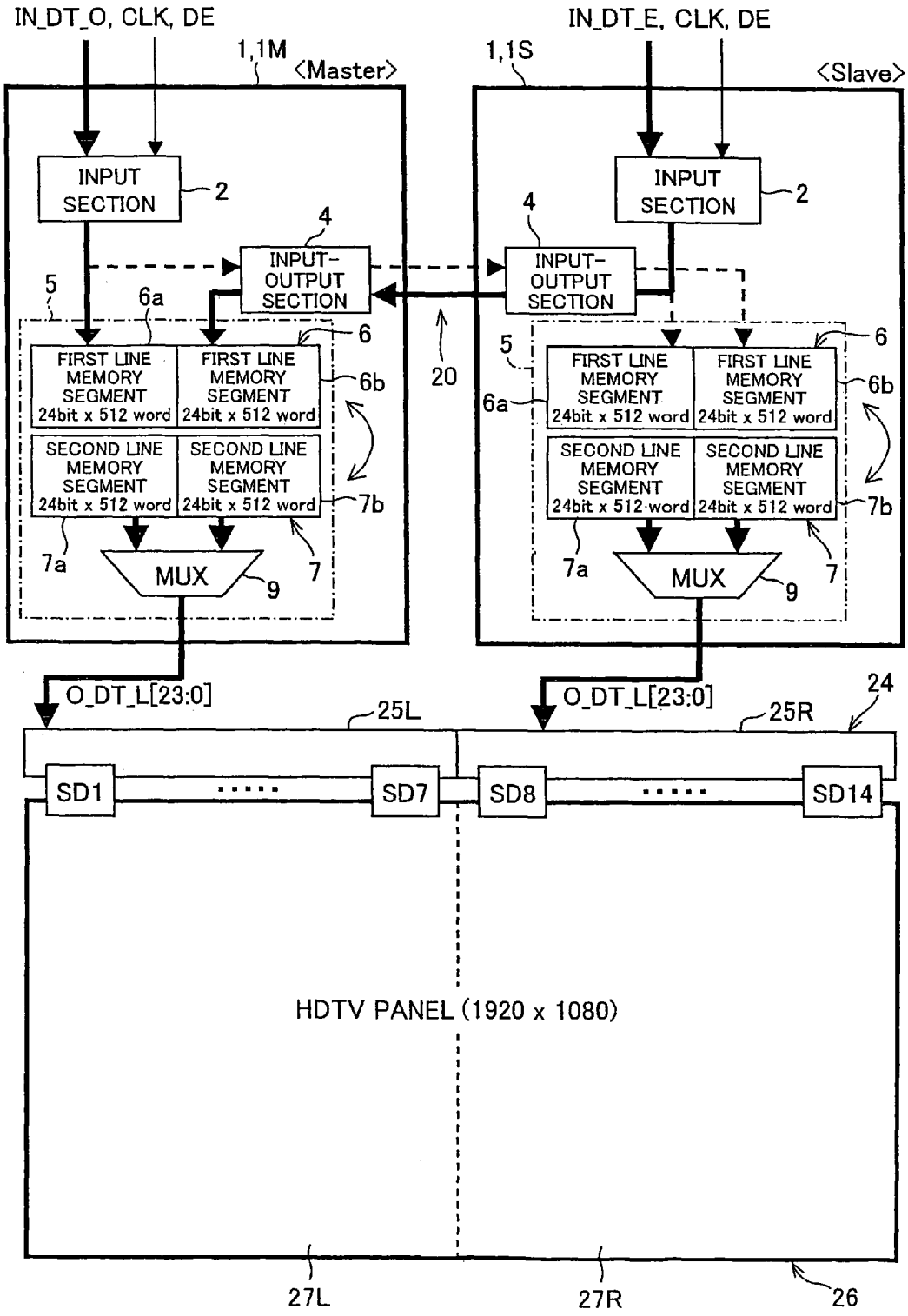
FIG. 4 is an explanatory diagram of an image data flow in a high resolution display apparatus including a display controller that has two display controller devices.

This is because, in the case where the line memories 6 and 7 are used in the HDTV panel as illustrated in FIG. 4, odd image data DT_O and even image data DT_E are inputted in parallel. In the case of the first line memory 6 in a Master (a main controller) (1, 1M), the first line memory segment 6*a* becomes a line memory segment for odd number and the first line memory segment 6*b* becomes a line memory segment for even number. The second memory 7 has the same arrangement as the first memory 6. In a case of the first line memory 6 in a Slave (a subordinate controller) (1, 1S), the odd image data and the even image data inputted into the first line memory are inputted respectively into the first line memory segment 6*b* and the first line memory segment 6*a*, that is, opposite of the case mentioned above.

There are two routes for image data input into the line memory section 5 as mentioned above. The routes are input from the input section 2 and input from the input-output section 4. When the line memory section 5 is used for the XGA, only the input from the input section 2 is used under the control of the controller section 3. When the line memory section 5 is used for the HDTV, both routes of the inputs from the input section 2 and the input-output section 4 are used.

The image data DT inputted into the line memory 5 is stored into either the first line memory 6 or the second line memory 7. The image data DT is stored from the left end of the first line memory 6 or the second line memory 7. The storage is performed at a timing of the clock signal CLK inputted together with the image data during the time having the "High" display enabling signal DE. Whether the inputted image data DT is stored in the first line memory 6 or in the second line memory 7 is controlled by the controller section 3. For example, when the image data DT is sequentially stored into the first line memory 6, reading of the image data from the second line memory 7 is carried out. In this way, for every one line, the storage (i.e., storing operation) of the image data DT and the reading (i.e., reading operation) of the image data DT are carried out alternately by the first line memory 6 and the second line memory 7.

When the image data is read from the line memory 5, the number of routes can be selected, according to need. Therefore, the number of the routes output routes) may be one or plural. As one example here, when the display controller device 1 is used for the XGA, the image data is read via two routes. In the case where the display controller is used for the HDTV, the image data is read via one route. The use of multiplexer 9 is limited to the case where the display controller is used for the HDTV.

The controller section 3, as mentioned above, controls each operation of the input section 2, the input-output section 4, and the line memory section 5 in the display controller device 1. According to whether the display controller device 1 is used for the XGA or for the HDTV, the controller section 3 causes the sections to perform the operation for the XGA or operation for the HDTV. A setting of the resolution is performed by an resolution specifying signal inputted from the outside. For example, when the resolution specifying signal is "High" level, the controller section 3 determines that the display controller device is to be used for the HDTV.

To be more specific, the controller section 3 carries out the storing operation and the reading operation of the image data in such a manner that the image data of every line is stored alternatively in the first line memory 6 or the second line memory 7. Under the control by the controller section 3, the display controller device 1 operates either in a first mode or in a second mode described below.

In the first mode, the display controller device 1 stores the image data in such a manner that one-line image data (image data for one line) inputted from the input section 2 is stored into either the first line memory 6 or the second line memory 7. However, the display controller device 1 does not transfer the image data through the data input-output section 4 to another display controller device 1.

In the second mode, the image data is inputted via two routes. That is, the image data via predetermined one of the two routes is inputted into the display controller device 1 and the image data via another one of the two routes is inputted into another display controller device 1. Image data for one line (one-line image data) thus received by the display controller device 1 include one-line image data (hereinafter, stay portion of the image data) for the screen whose driving the display controller device 1 controls by itself, and one-line image data (hereinafter, transfer portion of the image data) for a screen whose driving the controller device 1 does not control by itself, i.e., the another controller device 1 controls. The display controller device 1 stores the stay portion into either the first line memory 6 or the second line memory 7, together with image data transferred from the another display control device 1 via the data input-output section 4. (the transferred image data is "transfer portion" for the another display control device 1). The transfer portion of the image data received by the display control device 1 is transferred via the data input-output section 4 to a display control device 1 (here, the another display control device 1) that controls driving the screen for this transfer portion. (Note that the terms "stay portion" and "transfer portion" are used here merely for the sake of easy explanation, and do not have any particular technical meaning by themselves.) (The stay portion may be also described as that portion of image data which is for a screen, driving of which a controller circuit that receives the image data is in charge of controlling and the transfer portion may be also described as that portion of image data which is for a screen other than the screen, driving of which the controller circuit that receives the image data is in charge of controlling).

The controller section 3, in the case where the controller section is used in the HDTV, further determines whether the display controller device 1 is used as a Master (main controller) or as a Slave (subordinate controller). In the case in which the display controller device is used for the HDTV, two display controller devices 1 are used for the HDTV, as illustrated in FIG. 4. Accordingly, one of the two becomes the Master and the other becomes the Slave. The controller section 3 of the Master transmits, to the controller section 3 of the Slave, an operation controlling signal for a switchover of a bus direction between the Master and the Slave, that is, an operation controlling signal for controlling a function of the input-output section 4 of the Slave. The controller section 3 of the Slave switches functions of the input-output section 4 according to the operation controlling signal transmitted from the Master. The setting of the Master and the Slave like this between the two display controller devices is carried out according to a Master assigning signal inputted from the outside. For example, when the Master assigning signal is "High" level, the controller section 3 determines that the display controller device including the controller section 3 is the Master.

Next, each of the low resolution display apparatus and the high resolution display apparatus is explained by referring to FIG. 2 through FIG. 5, the each including the display controller device 1. Drawings and explanation of the scanning line driving circuit is omitted here also for convenience.

Figure 2:
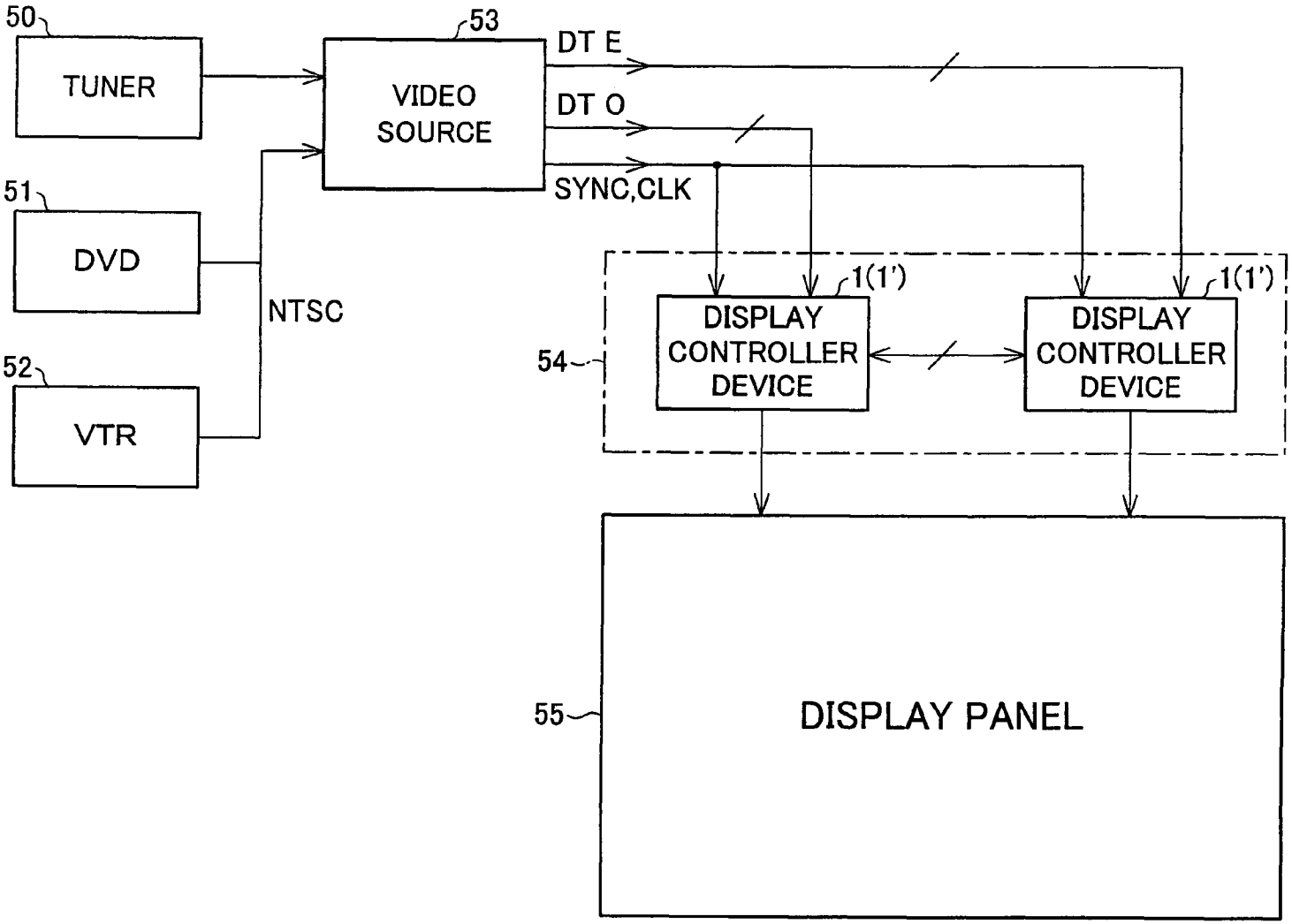
FIG. 2 is a block chart schematically illustrating an arrangement of entire image display routes for supplying image data to a display apparatus which includes a display controller device as a display controller.
Figure 6:
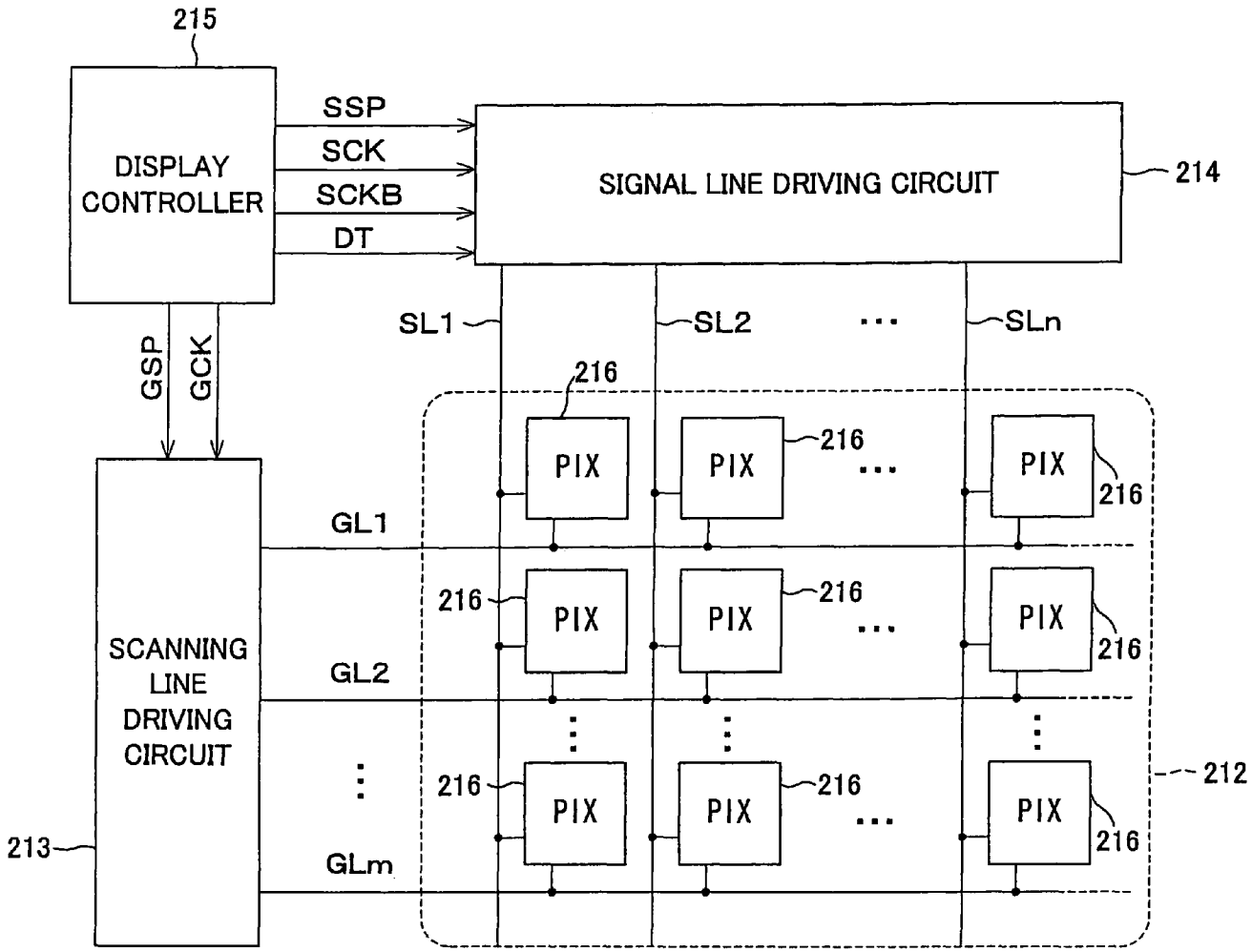
FIG. 6 is an explanatory diagram of an arrangement of a conventional active matrix LCD.
Figure 7:
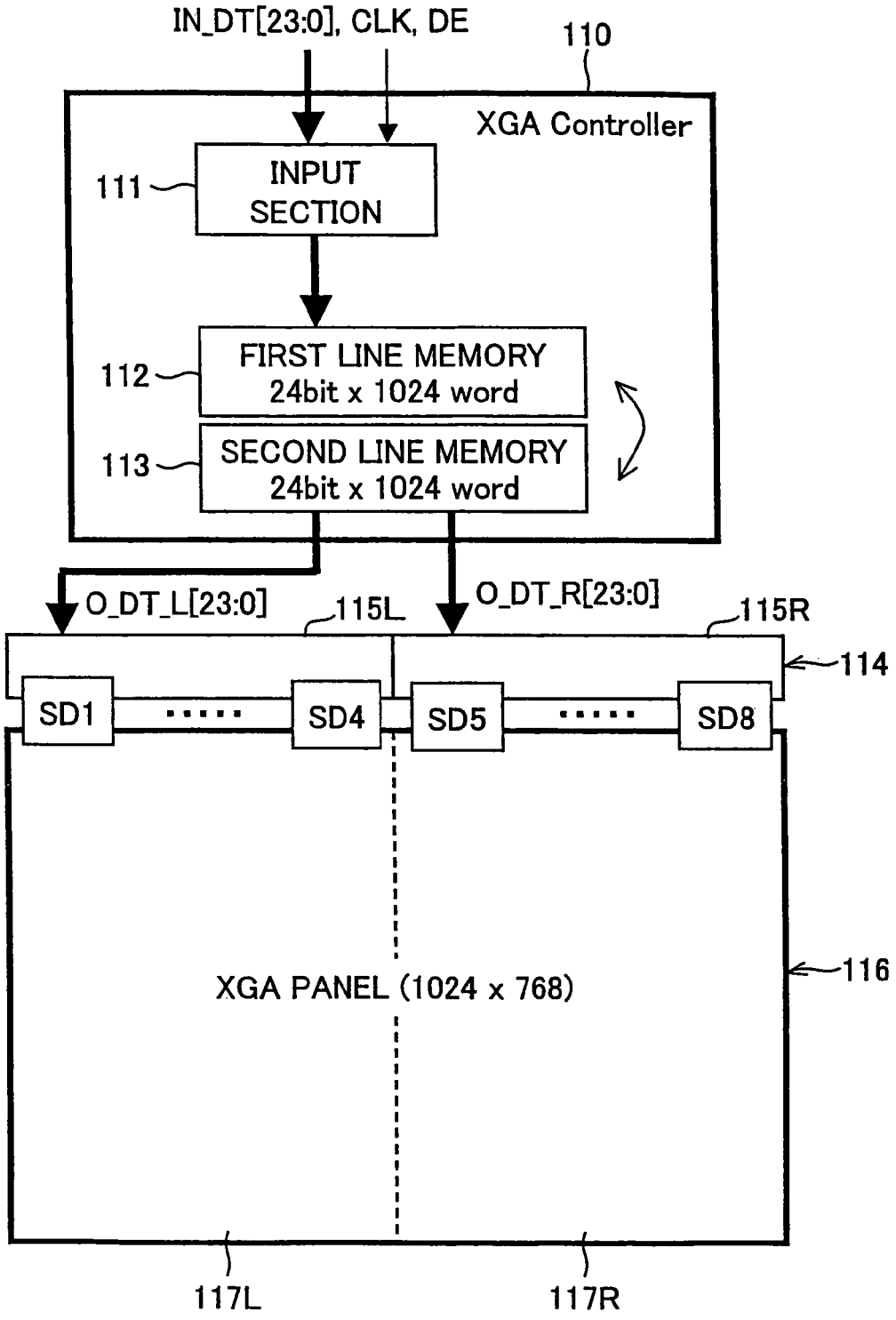
Prior Art FIG. 7
FIG. 7 is an explanatory diagram illustrating an image data flow in a conventional low resolution display apparatus.

As illustrated in FIG. 2, the image data DT is supplied in a form of a video signal under NTSC or the like from an external device such as a tuner 50, a DVD (Digital Versatile Disc) device 51, a VTR (Video Tape Recorder) device 52 etc. After the image data DT is converted into the image data DT, the clock signal CLK and the synchronized signal SYCN by a video source 53, the image data DT, the clock signal CLK, and the synchronized signal SYCN are supplied to a driving circuit section of a display panel 55 through a display controller 54 including one or plural display controller device(s) 1. The display panel 55 has a same arrangement as a display panel 212 as illustrated in FIG. 6. By way of example, FIG. 2 illustrates an arrangement in which the high resolution display apparatus that uses the HDTV panel as the display panel 55 is used. Accordingly, two of the display controller devices 1 are included in the display controller 54.

Figure 3:
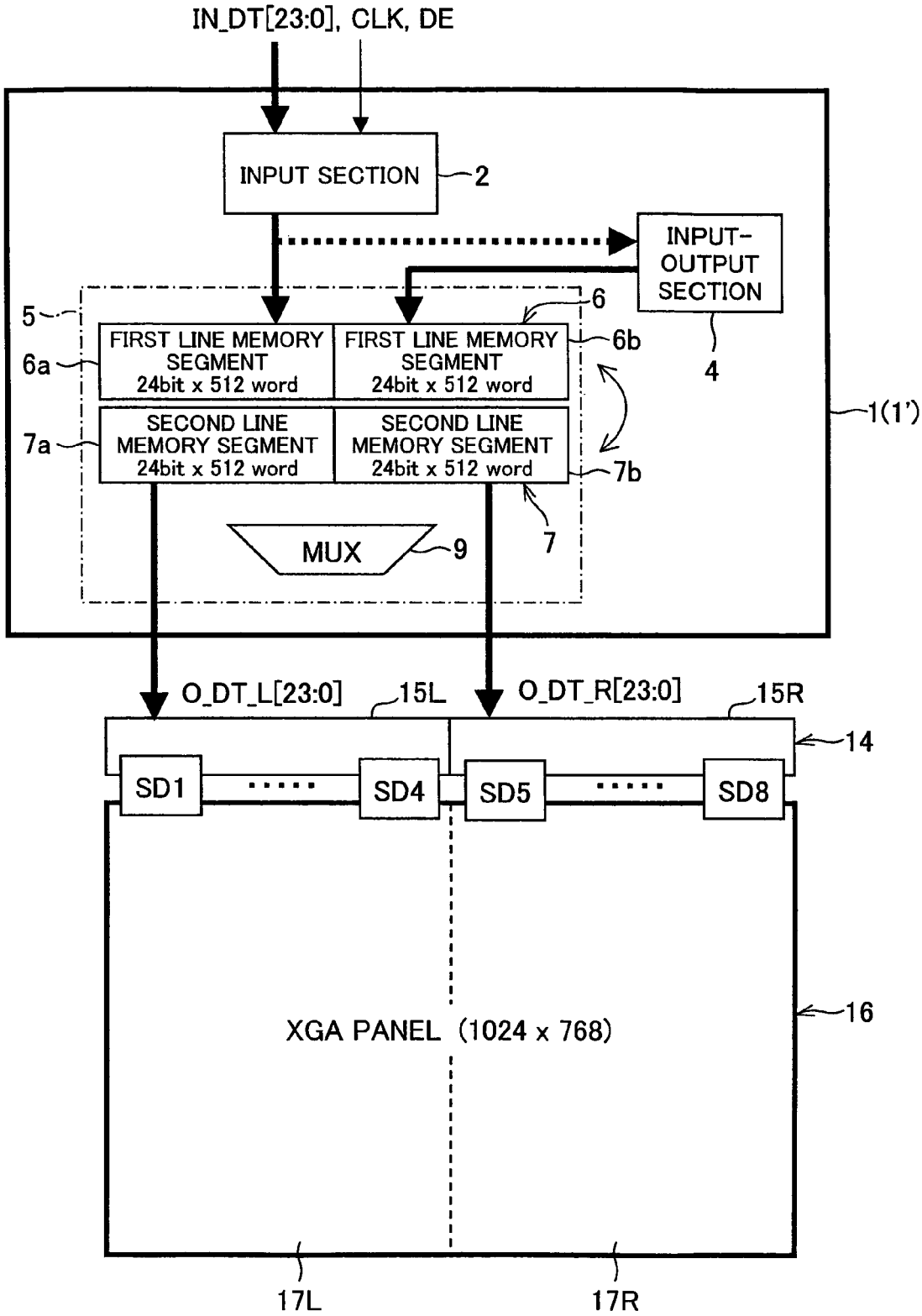
FIG. 3 is an explanatory diagram illustrating an image data flow in a low resolution display apparatus including a display controller that has one display controller device as in FIG. 1.

FIG. 3 illustrates the low resolution display apparatus using an XGA panel 16 as the display panel 55 illustrated in FIG. 2. The display apparatus includes the XGA panel 16, a signal line driving circuit 14, and the single display controller device 1. The signal driving circuit 14 drives plural signal lines (not illustrated) of the XGA panel 16. The XGA panel includes separate source substrates 15L and 15R respectively for the left screen and the right screen. The source substrate 15L includes four source drivers SD1 to SD4 formed and the source substrate 15R includes four source drivers SD5 to SD8 formed.

When the display controller device 1 is used for the XGA, the display controller device 1 operates in the first mode. Accordingly, the input-output section 4 of the display controller device 1 is not used and the image data DT, the display enabling signal DE, and the clock signal CLK, which are inputted from outside, are transmitted only to the line memory section 5 through the input section 2. Moreover, reading the image data from the line memory section 5 is carried out via two routes here. Thus, the image data of the left screen 17L and the image data of the right screen 17R are outputted at the same time.

Figure 8:
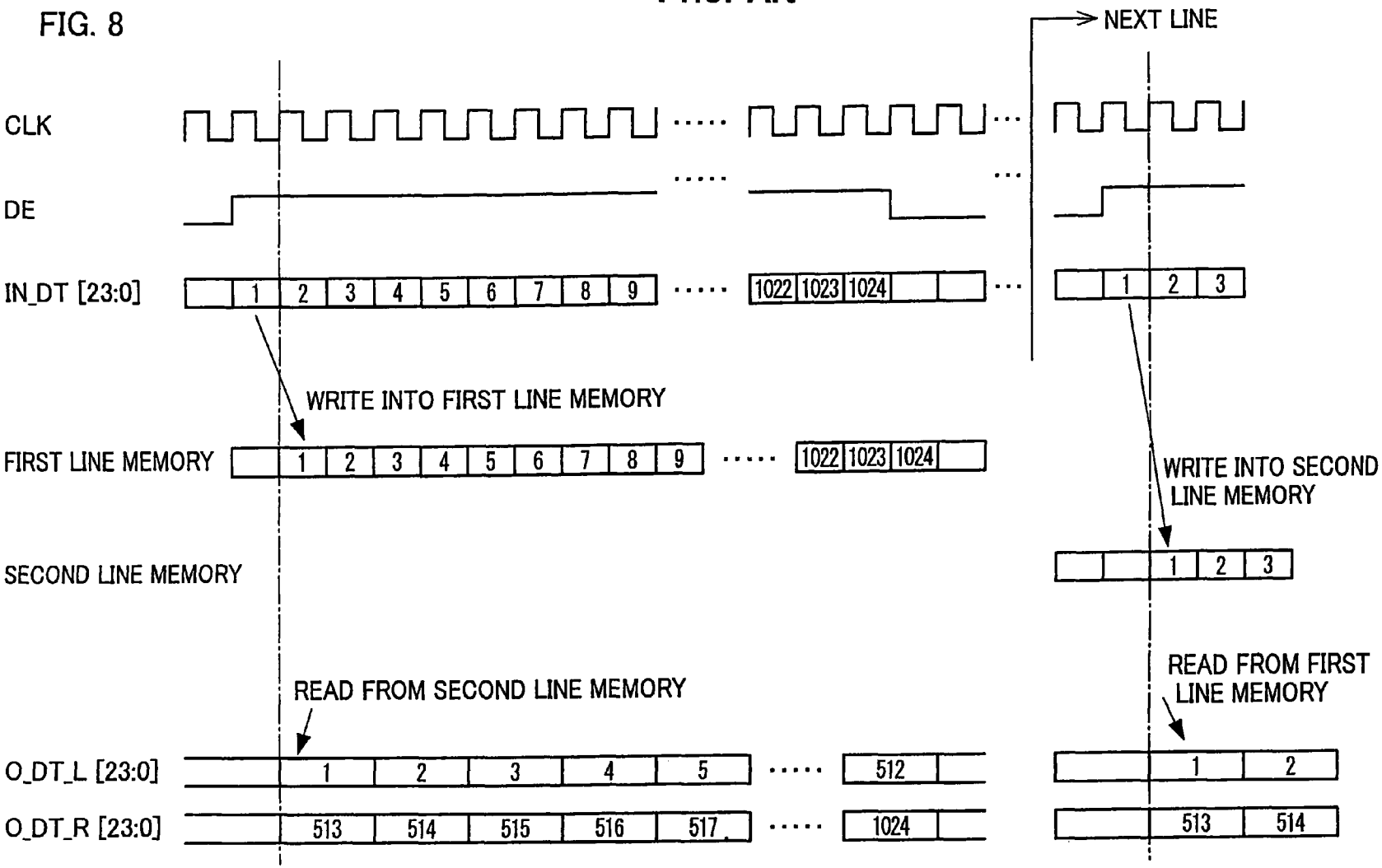
FIG. 8 Prior Art
FIG. 8 is a timing chart of the conventional low resolution display apparatus as in FIG. 6.
Figure 9:
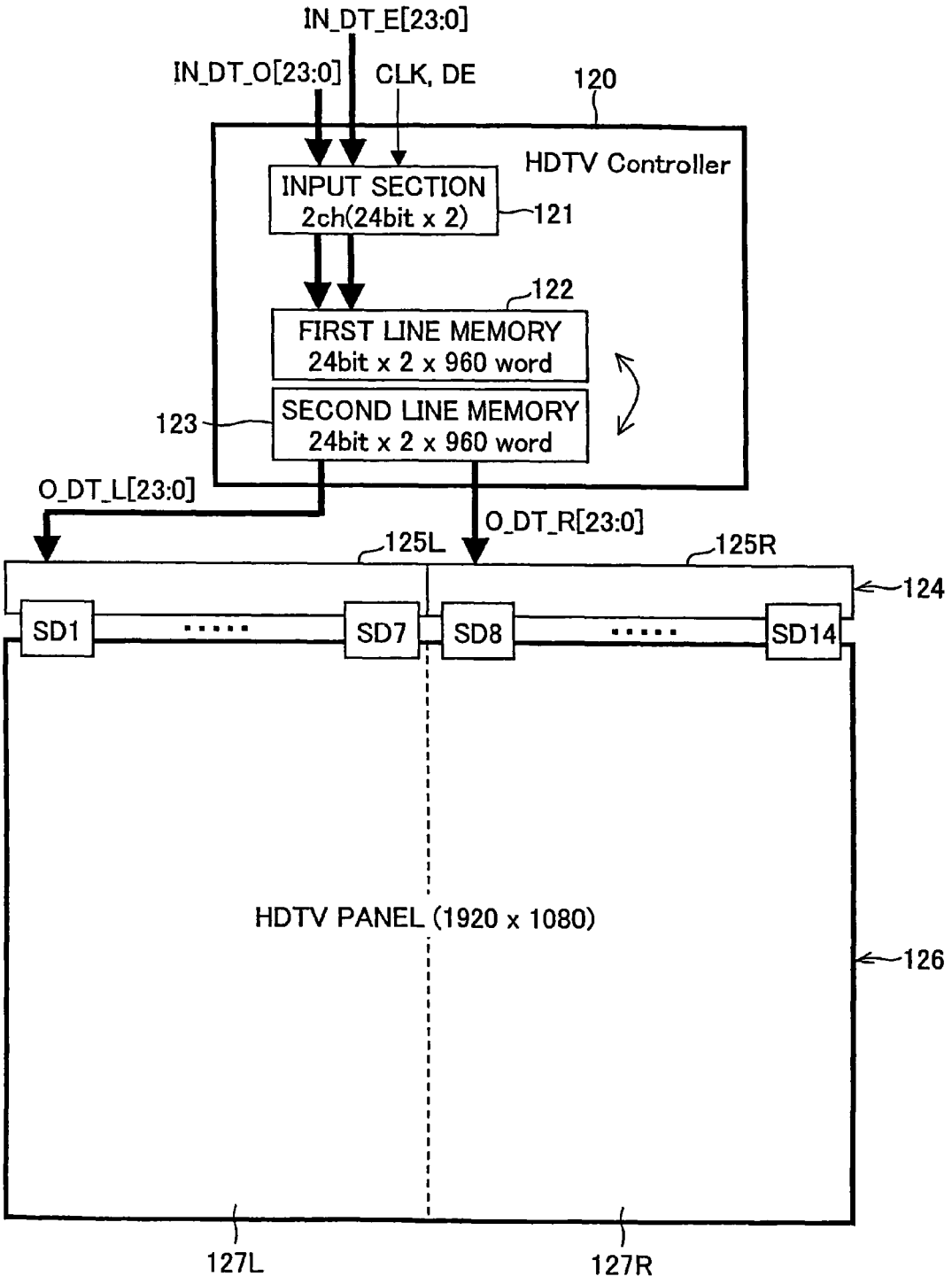
Prior Art FIG. 9
FIG. 9 is an explanatory diagram of an image data flow of a conventional high resolution display apparatus.
Figure 10:
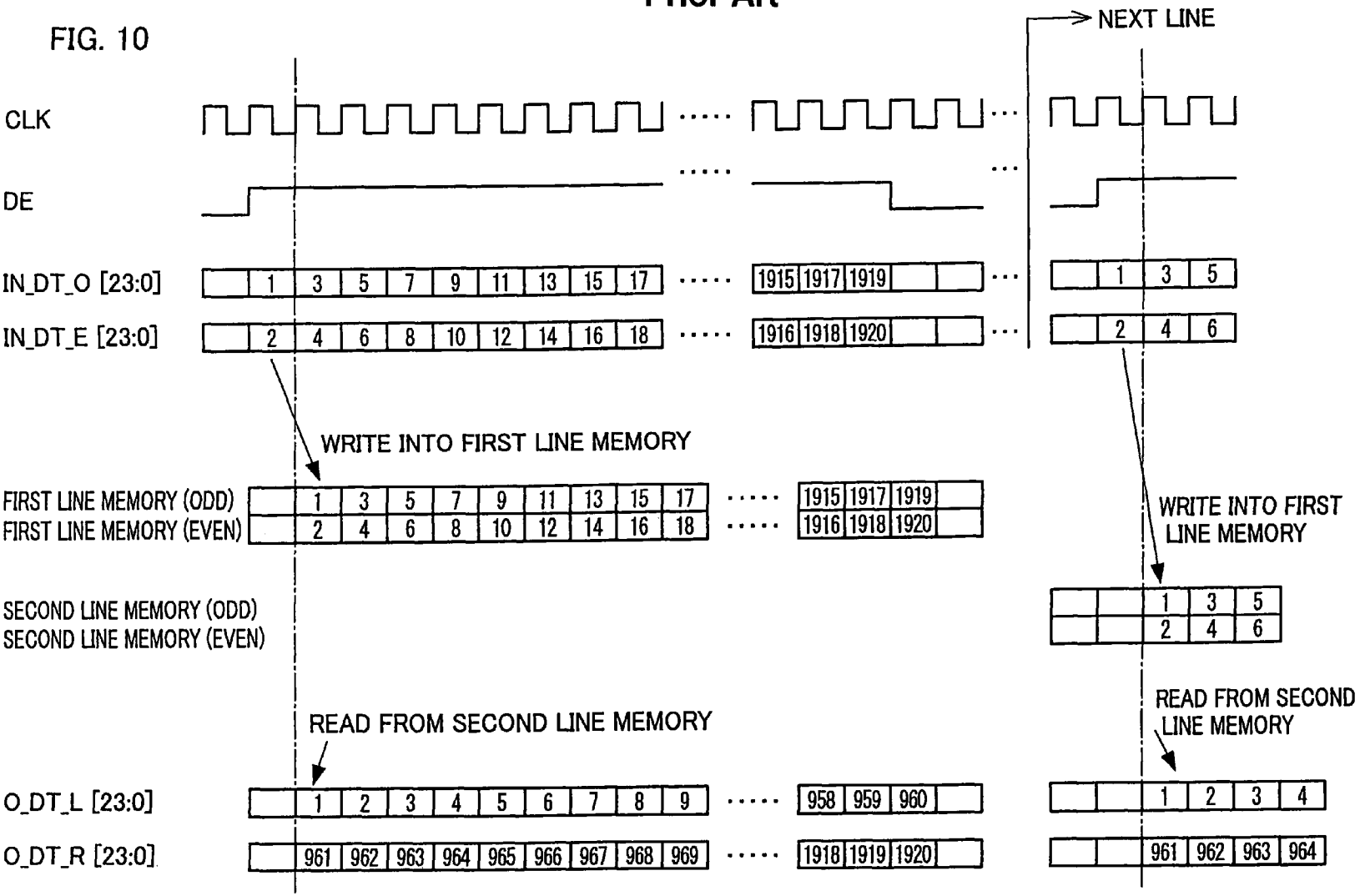
FIG. 10 Prior Art
FIG. 10 is a timing chart of the conventional high resolution display apparatus as in FIG. 8.
Figure 11:
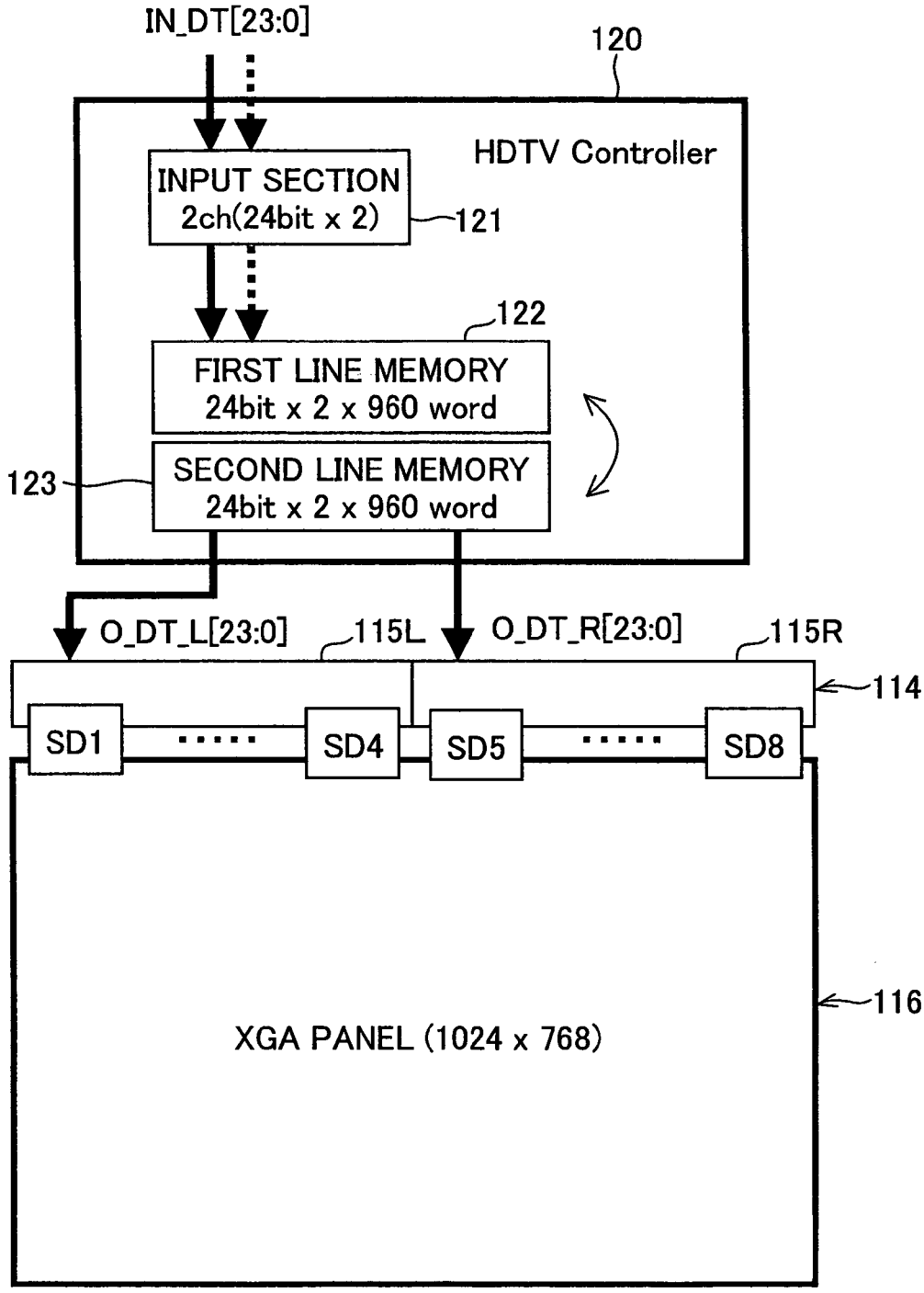
FIG. 11 is an explanatory diagram of an example in which one conventional display controller for high resolution display apparatus is provided in the low resolution display apparatus, in attempt of using the display controller as a display controller for common use.
Figure 12:
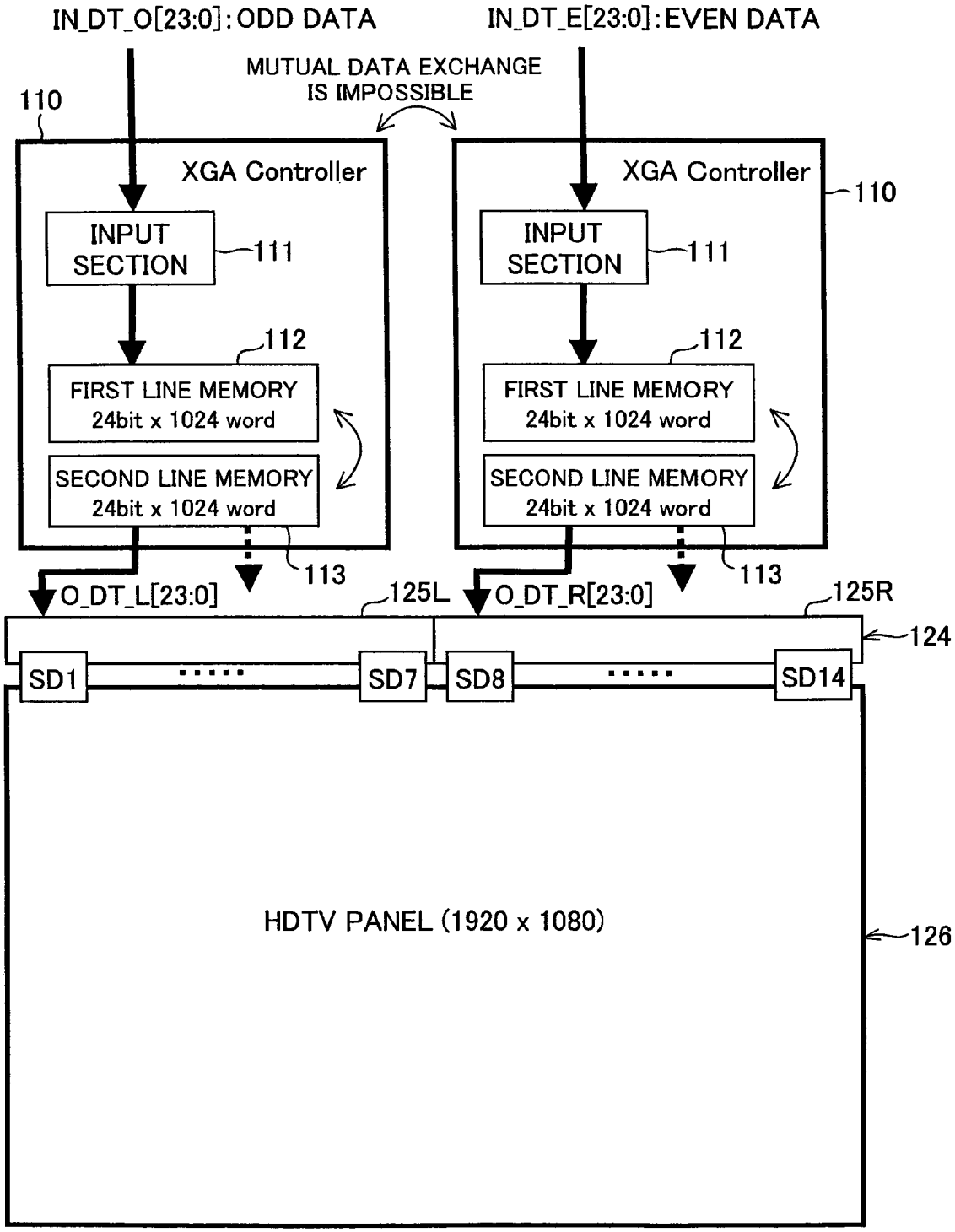
FIG. 12 is an explanatory diagram illustrating an example in which two display controllers for the conventional low resolution display apparatus are provided in the high resolution display apparatus, in attempt of using the display controllers as display controllers for common use.

A timing chart of the low resolution display apparatus using the XGA panel 116 is substantially same as FIG. 8 as explained above. In other words, the image data (in FIG., IN_DT) DT1, DT2, DT3, . . . , DT1024 inputted through the input section 2 are stored sequentially from the image data DT1 at the timing of the clock signal CLK during the time having the "High" display enabling signal DE. The image data is stored into the first line memory 6 from the left end of the line memory 6. In this exemplary embodiment, because both of the first line memory 6 and the second line memory 7 are made of a pair of line memory segments, the image data is stored, to be more precise, into the first line memory segment 6*a* from the left end thereof to the right end thereof, and then into the first line memory segment 6*b* from the left end thereof to the right end thereof.

At the same time as the image data storage into the first line memory 6, the previous-line image data (in FIG. O_DT) DT1, DT2, DT3, . . . , DT1024, which has been already stored in the second line memory 7, are read, starting from the image data DT1 for the left end of the screen and the image data DT513 for the center of the screen at the same time respectively from the left side of the second line memory 7. As mentioned above, both of the first line memory 6 and the second line memory 7 are made of a pair of line memory segments. Accordingly, to be more precise, the image data DT is read from each of the second line memory segment 7*a* and the second line memory segment 7*b* at the same time.

The image data DT1 for the left end of the screen is the first image data that should be written into the left screen 17L. The image data DT1 is read from the second line memory segment 7*a*. The image data DT1, DT2, DT3, . . . , DT512 read sequentially from the second line memory segment 7*a* are inputted into the four source drivers SD1 to SD4 for driving the left screen 17L in an order starting from the source driver SD1 located leftmost. On the other hand, the image data DT513 at the center of the screen is the first image data to be written into the right screen 17R. The image data 513 is read from the second line memory segment 7*b*. The image data DT513, DT514, DT515, . . . , DT1024 read sequentially from the second line memory segment 7*a* are inputted into the four source drivers SD5 to SD8 for driving the right screen 17R in an order starting from the source driver SD5 located leftmost. The output frequency is a half of the input frequency at this time.

The image data DT1, DT2, DT3, . . . , DT1024 of the next one line are stored into the second line memory 7, to be more precise, into the line memory segment 7*a* and then into the line memory segment 7*b*. The storage procedure is same as the procedure for storing the image data into the first line memory segments 6*a* and 6*b*. At the same time as the image data is stored into the second line memory 7, the image data DT1, DT2, DT3, . . . , DT512 and the image data DT513, DT514, DT515, . . . , DT1024 are read from the first line memory 6 via two routes in the same procedure as the procedure for reading from the second line memory segments 7*a* and 7*b*.

In this manner, the storage of the image data DT and the reading of the image data DT are sequentially carried out for every one line alternately by using the first line memory 6 or the second line memory 7.

On the other hand, FIG. 4 illustrates the high resolution display apparatus using the HDTV panel 26 as the display panel 55 illustrated in FIG. 2. The high resolution display apparatus includes the HDTV panel 26, the signal line driving circuit 24, and the two display controller devices 1 constituting the display controller.

The signal driving circuit 24 drives plural signal lines (not illustrated) of the HDTV panel 26. The display panel includes separate source substrates 25L and 25R respectively for the left screen and the right screen. The source substrate 25L includes seven source drivers SD1 to SD7 and the source substrate 25R includes seven source drivers SD8 to SD14.

In the case where the high resolution display apparatus is used, the two display controller devices are included in the display apparatus. Both of the display controller devices 1 operate in the second mode. Of the two display controller devices 1, one becomes the Master and the other becomes the Slave. In this embodiment, the display controller device 1 on the left side is the Master 1M and the display controller device 1 on the right side is the Slave 1S. The odd image data DT_O, the display enabling signal DE, and the clock signal CLK are inputted into the Master 1M from outside. On the other hand, the even image data DT_E, the display enabling signal DE and the clock signal CLK are inputted into the Slave 1S from outside.

A two-way data bus for connecting the input-output sections 4 of each of the Master and the Slave is provided between the Master 1M and the Slave 1S. The switchover of the bus directions in the data bus 20 like this is controlled according to the operation controlling signal (the signal for switching functions of the input-output section 4 of the Slave 1S) supplied from the Master 1M to the Slave 1S. In case of the HDTV, both of the Main 1M and the Slave 1S are arranged such that reading of the image data from each line memory section 5 in the Master 1M and the Slave 1S is carried out via one route.

Figure 5:
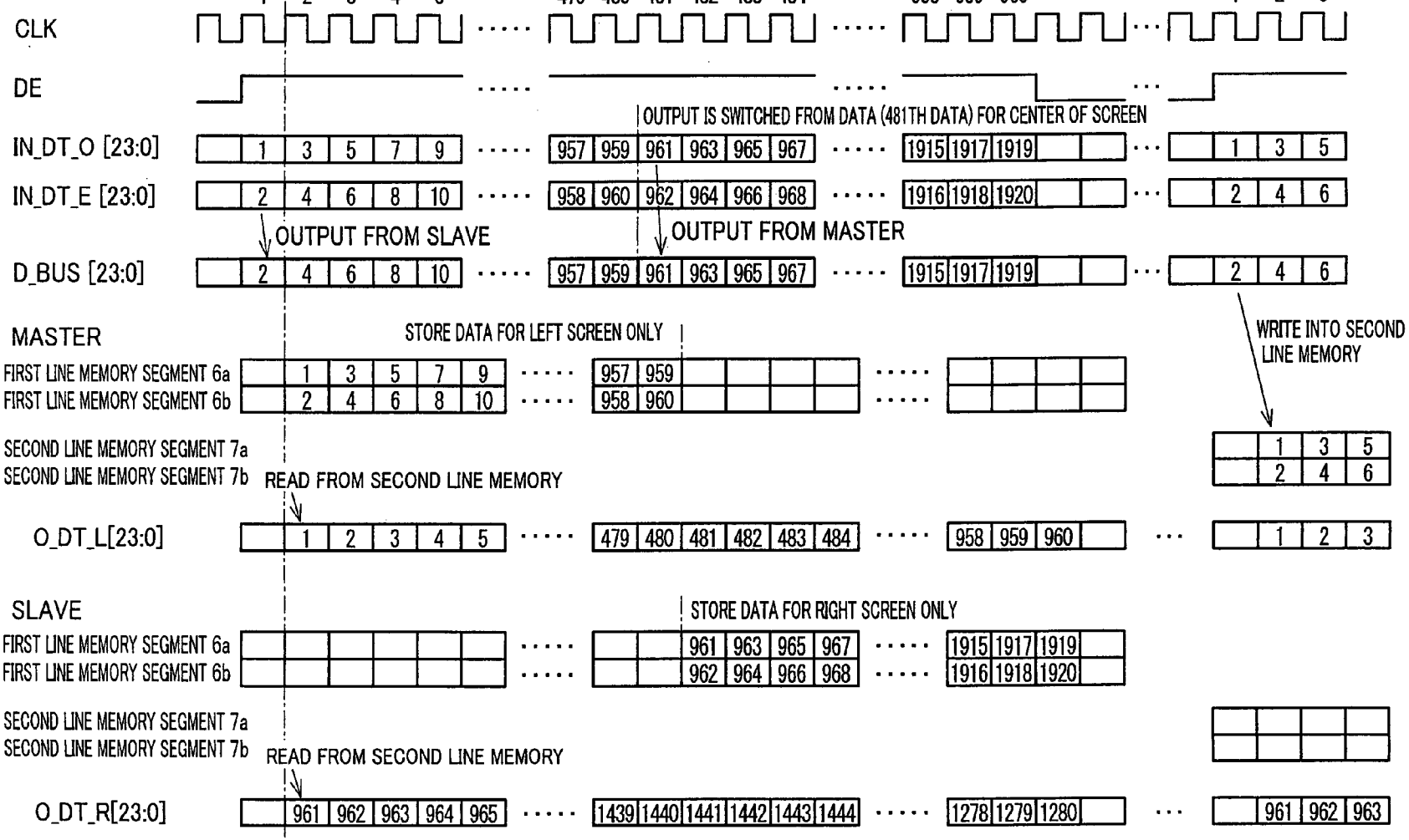
FIG. 5 is a timing chart in the high resolution display apparatus as in FIG. 4.

FIG. 5 illustrates a timing chart of the high resolution display apparatus using the HDTV panel 26. In the HDTV, both of the odd image data (in FIG., IN_DE_O) DT1, DT3, DT5, . . . , DT1919 and the even image data (in FIG., IN_DE_E) DT2, DT4, DT6, . . . , DT1920 are inputted at the same time together with the display enabling signal DE and the clock signal CLK. Among the image data, the odd image data DT1, DT3, DT5, . . . , DT1919 are inputted into the Master 1M together with the display enabling signal DE and the clock signal CLK. On the other hand, the even image data DT2, DT4, DT6, . . . , DT1920 are inputted into the input section 2 of the Slave together with the display enabling signal DE and the clock signal CLK.

In the Master 1M, under the control by the controller section 3 (not illustrated in FIG.), the odd image data DT1, DT3, DT5, . . . , up to DT959 are stored into the first line memory 6 for odd number in the line memory section 5, that is, the first line memory segment 6*a* from the left end thereof. The odd image data mentioned above is for one line of the left screen 27L (a former half). The odd image data is stored sequentially at the clock signal CLK timing inputted together during the time having the "High" display enabling signal DE.

On the other hand, in the Slave 1S, under the control by the controller section 3, the even image data DT2, DT4, DT6, . . . , up to DT 960, which are the even image data for the one line of the left screen 27L (a former half), are not stored into the line memory section 5 of the Slave 1S. However, the even image data mentioned above is transferred to the Master 1M together with the clock signal CLK and the display enabling signal DE inputted together. The transfer of the data and signals are carried out through the data bus 20 from the input-output section 4. During this period, the data is not stored into the line memory section 5 in the Slave 1S.

In the Master 1M, the odd image data DT1, DT3, DT5, . . . , up to DT959 are sequentially stored into the first line memory segment 6*a* from the left end thereof. At the same time as the storage, the even image data DT2, DT4, DT6, . . . , up to DT960 corresponding to the left screen 27L (the former half) of the same line are sequentially stored into the memory for even number in the first line memory 6 of the line memory section 5, that is, the first line memory segment 6*b* from the left end thereof. The storage is carried out by using the display enabling signal DE and the clock signal CLK transferred together from the Slave 1S at the clock signal CLK timing during the time having the "High" display enabling signal DE.

In this way, the image data (the odd image data and the even image data) is stored in the first line memory 6 of the Master 1M, the image data corresponding to the left screen 27L (the former half) of the one-line image data. Then, according to the operation controlling signal outputted form the controller section 3 of the Master 1M, the processes by the Master 1M and the Slave 1S are switched. After this switchover, the Master 1M transfers, to the Slave 1S, the odd image data that has been inputted through the input section 2.

Namely, the controller section 3 of the Master 1M does not store the odd image data DT961, DT963, DT965, . . . , DT1919, into the line memory section 5 of the Master 1M, the odd image data DT961, DT963, DT965, . . . , DT1919 corresponding to one line of the right screen 27R (a latter half). Instead, through the data bus 20 from the input-output section 4, the controller section 3 transfers the odd image data together with the clock signal CLK and the display enabling signal DE inputted at the same time to the Slave 1S. During this period, the Master 1M does not carry out the data storage into the line memory section 5 of the Master 1M.

In the Slave 1S, the even image data DT962, DT964, DT966, . . . , DT1920 are inputted through the input section 2 of the Slave 1S. The inputted even image data is stored into a memory for even numbers, that is, the first line memory segment 6*a* in the same way as the odd image data storage into the line memory segment 6*a* in the Master 1M. At the same time as the storage, the odd image data DT961, DT963, DT965, . . . , DT1919 are stored into the memory for odd numbers, that is, the first line memory segment 6*b* in the same way as the even image data storage into the first line memory segment 6*b* in the Master 1M, the odd image data transferred to the Slave 1S from the Master 1M through the input-output section 4.

In this way, the image data storage for one line is completed by exchanging input data of the Master 1M and the Slave 1S between the Master 1M and the Slave 1S.

At the same time as this storage period, the previous-line image data (in FIG., O_DT_L, O_DT_R) DT1, DT2, DT3, . . . , DT1920 is read sequentially from each of the second line memories 7 of the Master 1M and the Slave 1S, the image data having been already stored in the second line memories 7. Reading of the image data starts simultaneously from each of the image data DT1 from the left end of the screen and the image data DT961 for the center of the screen, reading from left to right. In this exemplary embodiment, each of the first line memory 6 and the second line memory 7 in the Master 1M and the Slave 1S are made of a pair of line memory segments. The image data, more specifically, is read from the second line memory segment 7*a* and the second line memory segment 7*b* from the left ends thereof to the right thereof in each of the Master 1M and the Slave 1S. The image data thus read out is outputted to the screen through the multiplexer 9 via one route.

The image data DT1, which is to be read in the Master 1M first and for the left end of the screen, is first image data to be written into the left screen 27L. The image data is read from both of the second line memory segment 7*a* storing the odd image data and the second line memory segment 7*b*: storing the even image data. The image data read from the second line memory segments 7*a* and 7*b* are alternately outputted via the multiplexer 9. The image data DT1, DT2, DT3, . . . , DT960 read sequentially starting from the image data DT1 for the left end of the screen are inputted into the seven source drivers SD1 to SD7 for driving the left screen 27L in order from the source driver SD1 located leftmost.

On the other hand, the image data DT961, which is read in the Slave 1S first, is the first data to be written into the right screen 27R. The image data is read from both of the second line memory segment 7*a* storing the even image data and the second line memory segment 7*b* storing the odd image data. The data read from the second line memory segment 7*a* and the second line memory 7*b* are alternately outputted via the multiplexer 9. The image data DT961, DT062, DT963, . . . , DT1920 read sequentially from the DT961 for the center of the screen are inputted into the seven source drivers SD8 to SD14 for driving the right screen 27R in order from the source driver SD8 located leftmost.

In this case, the output frequency is the same as the input frequency. When it is completed to store the image data DT1, DT2, DT3, . . . , DT1920 for one line into the first line memories 6 in the Master 1M and the Slave 1S, the second line memories 7 in the Master 1M and the Slave 1S have been emptied by then. The image data DT1, DT2, DT3, . . . , DT1920 for the next one line are stored into these empty second line memories 7 in the same way as the storage of the image data into the first line memories 6.

At the same time as these storage, the image data DT1, DT2, DT3, . . . , DT960 and the image data DT 961, DT962, DT963, . . . , DT1920 are read out of the first line memories 6 in the Master 1M and the Slave 1S via two routes from both of the left end of the screen and the center of the screen. The reading is carried out in the same way as the reading of the image data from the second line memories 7, as mentioned above.

In this way, in each of the Master 1M and the Slave 1S, the data conversion process is carried out by the controller section 3 in the same way as the process in the XGA. That is, the storage of the image data DT and the reading of the image data DT are carried out for every one line by using the first line memory 6 and the second line memory 7 alternately.

As mentioned above, in order to perform display by the high resolution display apparatus in which the image data, which are respectively for two pixels and inputted at a time via two routes, are converted into the image data for two screens (i.e., two sets of image data respectively for the two screens) by using the display controller (the two screens constitute one whole screen: the whole screen is divided (halved) into two screens horizontally) and then are outputted into the display driving sections via two routes by using the display controller, the present exemplary embodiment is arranged as follows: In the display operation of the high resolution display apparatus, the display controller includes two display controller devices 1, which have the same arrangement and are connected to each other via the data bus. The image data inputted via one of the two routes is inputted into one of the display controller devices 1, and the image data inputted via the other one of the two routes are inputted into the other one of the display controller devices 1. The image data respectively received by the display controller devices 1 contains image data that is for the screen whose driving one of the display controller devices 1 is in charge of controlling, and image data that is for the screen whose driving the other one of the display controller devices 1 is in charge of controlling. As to the image data other than the image data of the screen, driving of which the display controller devices 1 are in charge of controlling, the display controller devices 1 exchange such image data with each other the other through the data bus. On the other hand, the image data of the screen, driving of which the display controller devices 1 are in charge of controlling by themselves, is stored into the respective line memory sections 5 of the display controller devices 1 together with the image data transferred from the other through the data bus. Then the image data is converted into an output image data.

By the arrangement like this, the memory capacity of the line memory provided in each display controller device 1 can be reduced to a half of a memory capacity necessary in the case of the arrangement in which the display controller is made of one display controller device 1. For example, the display controller for the HDTV (1920×1080) conventionally requires to have a line memory of memory capacity substantially two times more than the memory capacity of the display controller for the XGA (1024×768). However, a display controller for the high resolution HDTV can be arranged by using the two display controller devices 1 each of which includes the line memory section 5 having the memory capacity of the display controller for the XGA.

Namely, this allows one type of the display controller device to be used for high resolution as well as the low resolution. Accordingly, it becomes possible to establish common use of the display controller device (controller). The common use is advantageous in terms of cost, thereby making it possible to lower cost of the display apparatus.

This embodiment exemplifies the case where N=2 and k=1, in order to explain a driving method in which (i) N sets of the image data respectively for N pixels (N is a whole number equal to or more than two) are inputted at a time via N routes, (ii) each image data is converted by the display controller to N sets of the image data respectively for N screens which constitute a whole screen that is horizontally divided into the N screens, and (iii) the image data is outputted to the display driving section by N×k routes (k is a whole number equal to or more than one). The present invention, of course, may be arranged such that N and k are other than N=2 and k=1.

In the case where one display controller is formed by including plural display controller devices 1, display controlling signals (such as the clock signal CLK, the display enabling signal DE and the like) as well as the image data DT are inputted together. Accordingly, each display controller device 1 recognizes which screen it is in charge of. Then each display controller device 1 stores, into the line memory section 5 thereof, only the image data of the screen that it is in charge of, and transfers, to the other, the image data of a screen other than the screen that it is in charge of. As the result, the display controllers 1 in this case are expected to be able to drive the screens independently. However, in the reality, a problem may occur due to difference in the length of the data transfer channel, uneven properties of each display controller device due to production, and the other reasons.

In order to solve the problem, in this exemplary embodiment, when the display controller is arranged for the high resolution display apparatus, either the two display controller devices 1 becomes the Master 1M and controls driving of the Slave 1S. This prevents a rise of the problem caused by the difference in the length of the data transfer channel, the production-derived uneven properties of each display controller device constituting each controller circuit, and the like.

When one display controller is formed by including plural display controller devices 1, the display controlling signal (such as the clock signal CLK and the display enabling signal DE and the like) as well as the image data DT are inputted together into each display controller device 1. Therefore, the display controller devices may be arranged such that the display controller devices store the transferred image data into the line memory section 5 by using the display controlling signal directly inputted therein. However, in the reality, as mentioned above, the problem may occur due to the difference in the length of the data transfer channel or the production-derived uneven properties of each display controller device 1 when the transferred image data is stored by using the display controlling signal directly inputted into the display controller devices 1.

This problem can be solved by the arrangement of this exemplary embodiment. In the arrangement of this exemplary embodiment, when the image data DT is transferred to another display controller device 1, the display controlling signal including the clock signal CLK inputted together with the image data DT is transferred. This prevents a rise of the problem caused by the difference in the length of the data transfer channel, the production derived uneven properties of each display controller device constituting each controller circuit, and the like.

Moreover, a number of image data bus lines is large. Because of this, by using the two-way data bus that is duplex as in this embodiment, the scale of the controller circuit can be reduced to a large extent. However, when the two-way data bus is used, switchover of the bus directions takes time. This may cause missing (i.e. missing out of a part of the whole image data for one screen) even if, for example, it is predetermined that a direction of the bus is switched from a predetermined numbered pixel.

In order to solve the problem, this exemplary embodiment is arranged as illustrated in the timing chart of FIG. 5. That is, the storage of the odd image data inputted directly into the first line memory segment 6*a* and the storage of the even image data, which is transferred data, into the first line memory segment 6*b* are carried out at the same clock timing in this arrangement. However, it is more preferable in the arrangement that the start timing for storing the transferred image data be delayed by some clocks to the start timing for storing the image data directly inputted. By arranging in this way, the time for switching the two-way data bus can be ensured. Accordingly, a problem due to delay necessary for switching the bus directions can be avoided.

Embodiment 2

Another exemplary embodiment of the present invention is explained below, referring to FIG. 13 and FIG. 14. For the convenience of the explanation, a member having the same function as a member in a first exemplary embodiment mentioned above is denoted by the same code and an explanation of the member is omitted.

In the first exemplary embodiment, a high resolution display apparatus as illustrated in FIG. 4 and FIG. 5 is exemplified. The high resolution display apparatus is arranged so that (i) image data respectively for two pixels (an odd pixel and an even pixel) are inputted at a time via two routes; (ii) the image data of one of the two routes is inputted into either two display controller devices 1; (iii) the image data of the other route is inputted into the other one of the display controller devices 1 (the other display controller device 1).

In order to realize the display apparatus like this with the display controller device that can be commonly used for the low resolution and the high resolution, the display controller device 1 in the Embodiment 1 includes a first mode and a second mode, under control of a controller section 3. In the first mode that is used for low resolution, the display controller device 1 stores the image data in such a manner that one-line image data (image data for one line) inputted from the input section 2 is stored into either the first line memory 6 or the second line memory 7. However, the display controller device 1 does not transfer the image data through the data input-output section 4 to another display controller device 1. On the other hand, the second mode is used for high resolution. In the second mode, the image data is inputted via two routes. That is, the image data via predetermined one of the two routes is inputted into the display controller device 1 and the image data via another one of the two routes is inputted into another display controller device 1. Image data for one line (one-line image data) thus received by the display controller device 1 include one-line image data (hereinafter, stay portion) for the screen whose driving the display controller device 1 controls by itself, and one-line image data (hereinafter, transfer portion) for a screen whose driving the another controller device 1 does not control by itself, i.e., the another controller device 1 controls. The display controller device 1 stores the stay portion into either the first line memory 6 or the second line memory 7, together with image data transferred from the another display control device 1 via the data input-output section 4. (the transferred image data is "transfer portion" for the another display control device 1). The transfer portion for the display control device 1 is transferred via the data input-output section 4 to a display control device 1 (here, the another display control device 1) that controls driving the screen for this transfer portion.

On contrary to this, this embodiment exemplifies the high resolution display apparatus arranged so that the image data for one pixel is inputted at a time via one route.

In order to realize the display apparatus like this with the display controller device shared for low resolution and high resolution, the display controller device 1', under the control of the controller section 3, includes the first mode, a third mode, and a fourth mode. The first mode is used for low resolution. In the first mode, the display controller device 1' does not transfer the image data through the data input-output section 4. However, the display controller device 1' stores, into either the first line memory 6 or the second line memory 7, the one-line image data inputted by an input section 2. The third and fourth modes are used for high resolution. In the third and fourth modes, image data for one line (one-line image data) thus received by the display controller device 1 include one-line image data (hereinafter, stay portion) for the screen whose driving the display controller device 1 controls by itself, and one-line image data (hereinafter, transfer portion) for a screen whose driving the another controller device 1 does not control by itself, i.e., the another controller device 1 controls. In the third mode, the display controller device stores the stay portion into either the first line memory 6 or the second line memory 7. The transfer portion for the display control device 1' is transferred via the data input-output section 4 to a display control device 1' (here, the another display control device 1) that controls driving the screen for this transfer portion. In the fourth mode, the display controller device 1' stores the stay portion into either the first line memory 6 or the second line memory 7, the one-line image data inputted via the data input-output section 4 from the another display controller device 1'.

Figure 13:
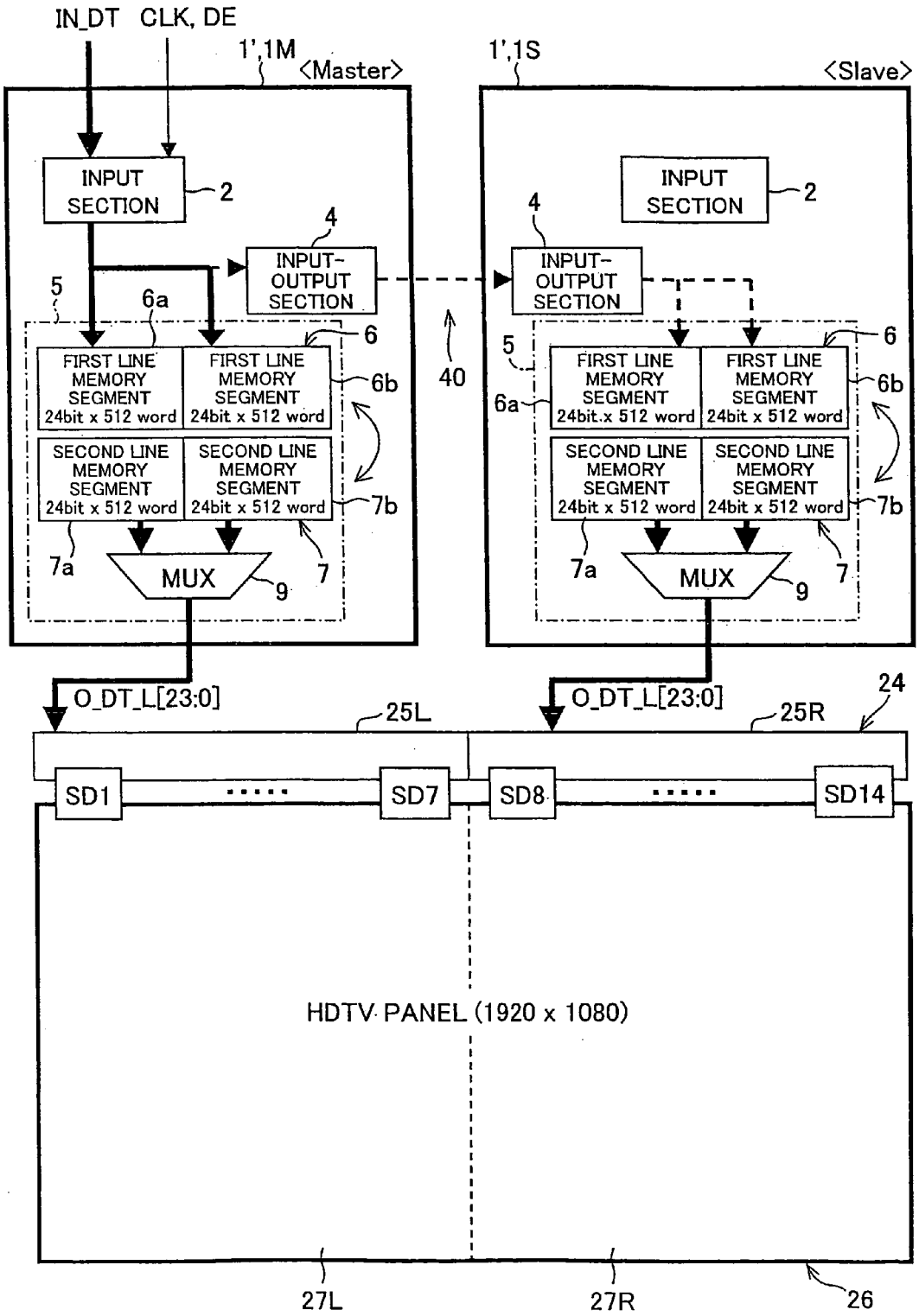
FIG. 13 is an explanatory diagram of an image data flow of another high resolution display apparatus including a display controller that has two display controller devices as in FIG. 1, according to another embodiment of the present invention.

FIG. 13 illustrates an image data flow in the high resolution display apparatus in this embodiment. In the high resolution display apparatus of this embodiment, two display controller devices 1' are included. The image data DT is inputted via one route together with a display enabling signal DE and a clock signal CLK only into either the controller devices 1'. The display controller device 1', into which the image data DT and the signals DE and CLK are inputted, becomes a Master. In this case, the image data DT and the signals DE and CLK are inputted into the display controller device 1' located on the left. In the following explanation, it is supposed that the display controller device 1' on the left is the Master 1M and the display controller device 1' on the right is the Slave 1S.

The Master 1M operates in the third mode and the Slave 1S operates in the fourth mode. Between the Master 1M and the Slave 1S, a data bus 40 connecting the input-output sections 4 of the Master 1M and the Slave 1S is provided in the same way as the first embodiment. Here, because the image data is transmitted only in one way from the Master 1M to the Slave 1S, the data bus 40 is one-way data bus. Reading of the image data from each of line memory sections 5 in the Master 1M and the Slave 1S are carried out via one route.

Figure 14:
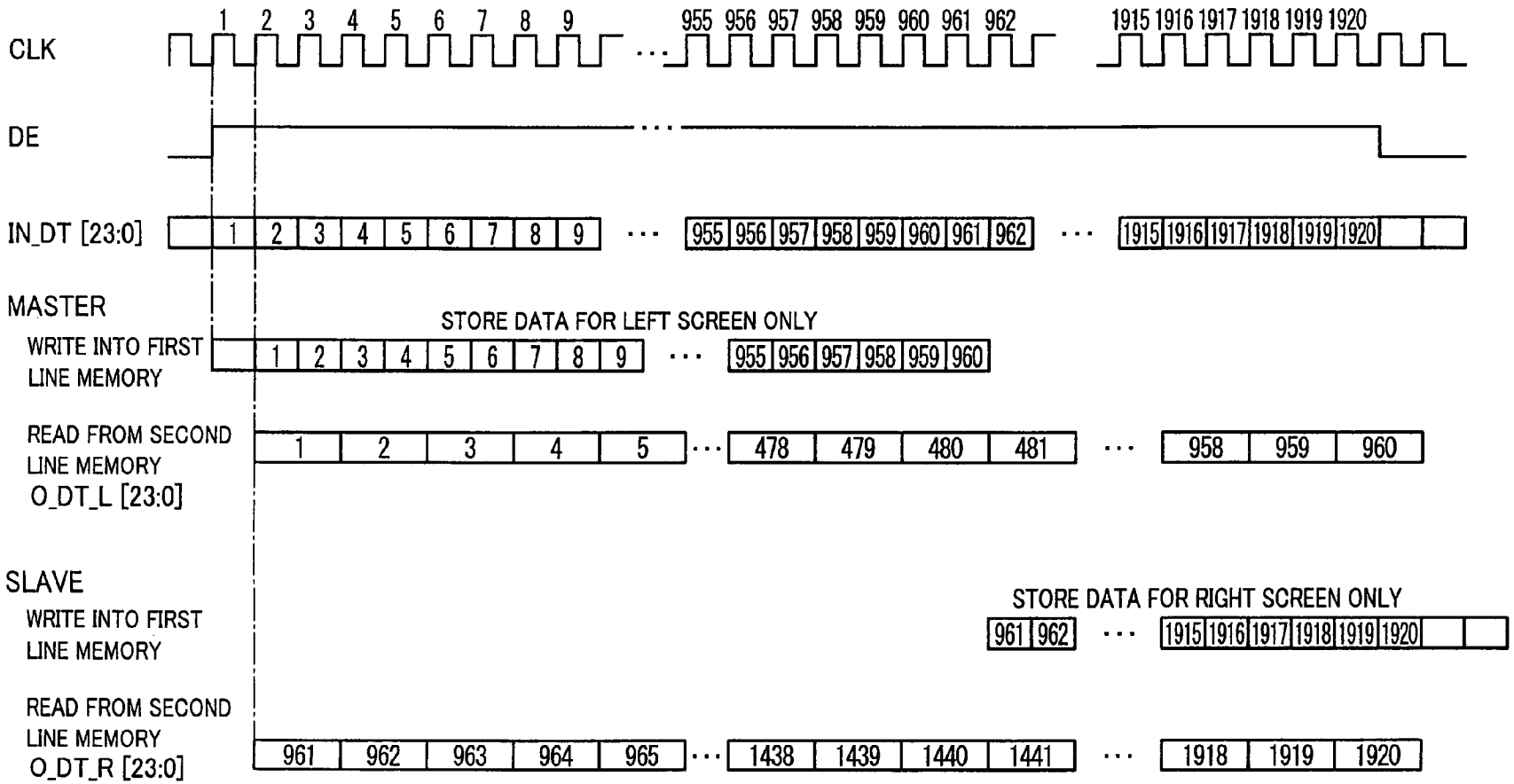
FIG. 14 is a timing chart of a high resolution display apparatus as in FIG. 13.
Figure 15:
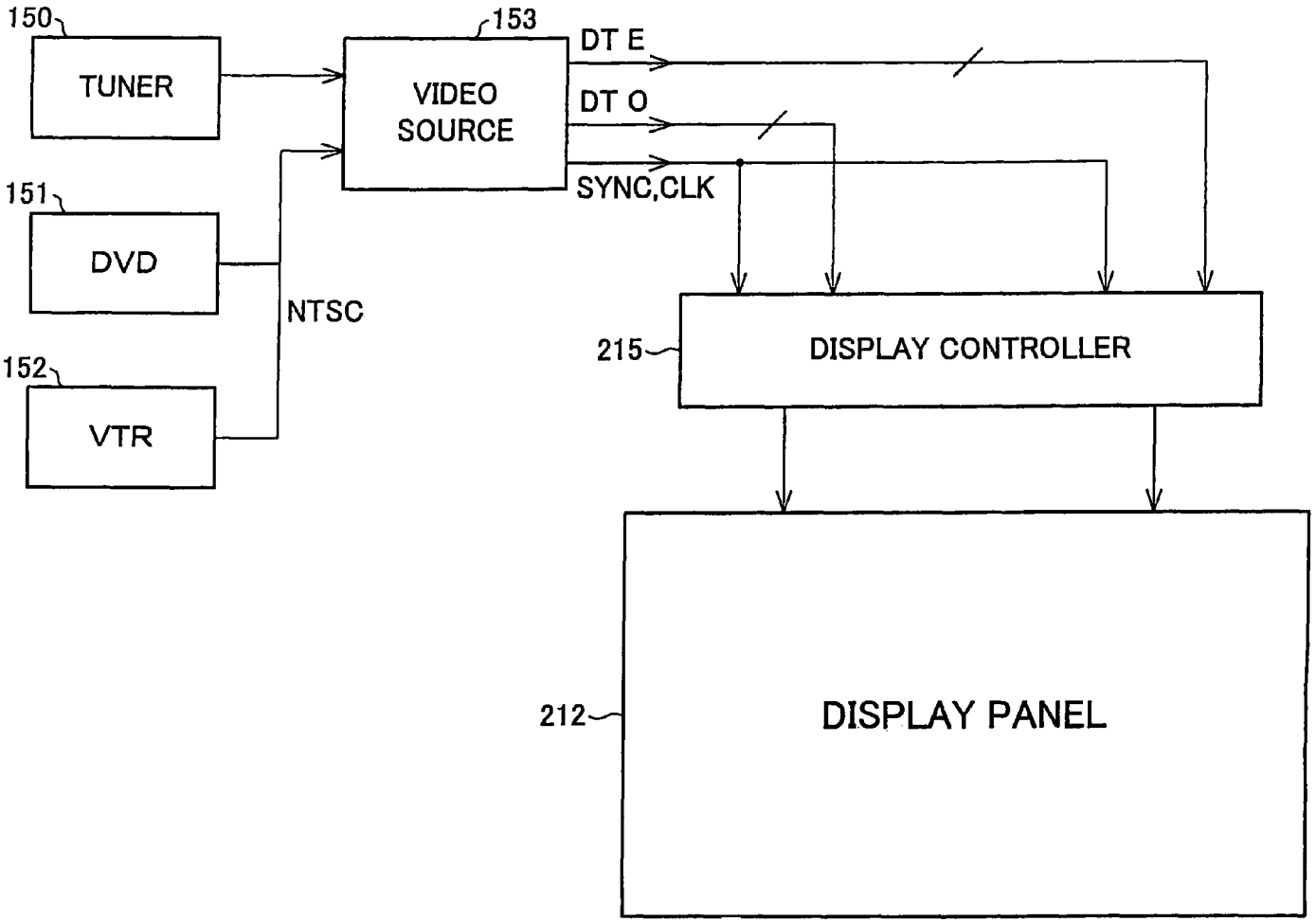
FIG. 15 is a block chart schematically illustrating entire image display routes for supplying image data to a conventional display apparatus including a display controller.

FIG. 14 is a timing chart of the high resolution display apparatus of this embodiment.

The image data (In FIGS. IN_DT) DT1, DT2, DT3, . . . , DT1920 are inputted, into the input section 2 of the Master 1M, together with the display enabling signal DE and the clock signal CLK.

In the Master 1M, under the control of the controller section 3 (not illustrated), the image data DT1, DT2, DT3, . . . , up to DT960, which are the thus inputted one-line image data corresponding to the left screen 27L (a former half), are stored into the first line memory 6 of the line memory section 5 from a left end of the first line memory 6. The storage is carried out sequentially at the timing of the clock signal (CLK) during a period in which the display enabling signal DE is "high", the clock signal (CLK) inputted together with the image data. To be more precise, the image data is stored from the left end to the right end of the first line memory segment 6*a*, and then into the left end to the right end of the first line memory 6*b*.

The image data DT961, DT962, DT963, . . . , DT1920 which are the thus inputted one-line image data corresponding to the right screen 27R (a latter half), are not stored into the line memory section 5 of the Master 1M, but are transferred to the Slave 1S together with the clock signal CLK and the display enabling signal DE through the data bus 40 from the input-output section 4.

In the Slave 1S, the image data DT961, DT962, DT963, . . . , DT1920 transferred from the Master 1M through the input-output section 4, are stored into the first line memory 6 of the line memory section 5 from the left end of the first line memory 6, according to the display enabling signal DE and the clock signal CLK. The storage is carried out sequentially at the clock signal CLK timing during a period in which the display enabling signal DE is "high". In this case also, to be more precise, the image data is stored into the first line memory segment 6*a* from the left end to the right end, and then, into the first memory segment 6*b* from the left end to the right end.

At the same time the storage of the image data as mentioned above is carried out, the previous-line image data (In FIG., O_DT_L, O_DT_R) DT1, DT2, DT3, . . . , DT1920, which has been already stored, are read sequentially from the second line memories 7 of the Master 1M and the Slave 1S. The reading is performed in parallel from the left ends of the second line memories 7. The reading starts from the image data DT1 at the left end of the screen and the image data DT961 at the center of the screen. In the display controller device 1', both of the first line memory 6 and the second line memory 7 are made of a pair of line memory segments. Because of this, to explain more in details, after the image data is read from the second line memory segments 7*a* from the left end thereof in the Master 1M and the Slave 1S, the image data is read from the second line memory segments 7*b* from the left end thereof.

In the Master 1M, the image data DT1 for the left end of the screen is the data that is read first. The image data DT1 is also first data to be written into the left screen 27L. The image data DT1, DT2, DT3, . . . , up to DT960 read sequentially from the image data DT1 for the left end of the screen, are inputted into seven source drivers SD1 to SD7 in order from the source driver SD1 located leftmost, the image data read sequentially from the left end of the second line memory segment 7*a*.

On the other hand, in the Slave 1S the image data DT961 for the center of the screen is the data that is read first. The image data DT961 is also first data to be written into the left screen 27R. The image data DT961, DT962, DT963, . . . , DT1920 read sequentially from the image data DT961 for the screen are inputted into seven source drivers SD8 to SD14 in order from the source driver SD8 located leftmost, the image data read sequentially from the left end of the second line memory segment 7*a*.

As mentioned above, the high resolution display apparatus of the present invention is applied to the case where (i) the image data is inputted via one route in such a manner that the image data for one pixel is inputted at a time; (ii) the thus inputted image data is are converted into the image data for N screens (i.e. N sets of image data for the N screens) by using the display controller (the N screens constitute one whole screen: the whole screen is divided into the N screens horizontally); (iii) and then the thus converted image data are outputted into the display driving sections via by N×k routes by using the display controller. Here, N is a whole number equal to or more than two, N=2 in this embodiment and k is a whole number equal to or more than one) routes. The high resolution display apparatus of this embodiment has a following arrangement: (a) the display controller is provided with N display controller devices 1', which have identical arrangements and are connected to each other via the data bus; (b) The image data is inputted into only one of the display controller devices 1.' (c) The display controller device 1' into which the image data is inputted stores into the line memory section 5 thereof the image data of the screen, driving of which the display controller device 1' is in charge of controlling; (d) On the other hand, the display controller device 1' transfers, through the data bus to a prescribed display controller device 1', the image data corresponding to a screen other than the screen, driving of which the display control device 1' is in charge of controlling, the prescribed display controller device 1' being in charge of controlling driving of the screen other than the screen, driving of which the display control device 1' is in charge of controlling.

Accordingly, compared with two input route arrangement in which the image data is inputted into two pixels at a time as illustrated in FIG. 4, the input frequency is doubled. However, because the input is carried out by one route, number of pins for interface connectors and number of connecting cables become half of the two input route arrangement. This can lead to such a merit that cost is reduced.

In this embodiment, the display controller device 1' is arranged so as to include the third mode and the fourth mode in addition to the first mode. However, by including all the second through fourth modes corresponding to the high resolution in addition to the first mode, one kind of the display controller device can be applied to both of the arrangements: (i) the arrangement in which the image data is inputted two pixels at a time via two routes, as exemplified in Embodiment 1 and (ii) the arrangement in which the image data is inputted one pixel at a time via one route as exemplified in Embodiment 2. Accordingly, the cost merit resulting from the integration (common use) can be more effective.

A display apparatus driving method of the present invention is a method, in which (i) N sets of image data respectively for N pixels are inputted at a time respectively via N routes (N is a whole number equal to or more than two), (ii) the N sets of image data are converted, by a display controller, to N sets of image data respectively for N screens, where a whole screen is divided into the N screens horizontally, and (iii) the N sets of image data is outputted to a display driving section via N×k routes (k is a whole number equal to or more than one). In order to solve the problem mentioned above, the display apparatus driving method of the present invention is arranged such that the display controller includes N controller circuits connected to each other via a data bus or data buses and respectively including a line memory, wherein the N sets of image data are inputted into the N controller circuits respectively via N routes. In order to solve the problem mentioned above, the display apparatus driving method of the present invention is further arranged such that each of the N controller circuits (i) transfers a transfer portion of the thus inputted image data via the data bus or data buses to another one of the N controller circuits that is in charge of controlling driving of a screen that the transfer portion is for, (ii) stores a stay portion of the thus received image data in its own line memory together with a transfer portion that is for the screen, driving of which that one of the N controller circuits is in charge of controlling and is transferred to that one of the N controller circuits, and (iii) converts, into output image data, the stay portion and transfer portion thus stored in its own line memory, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling. It is preferable that each of the N controller circuits include an identical semiconductor chip.

In this method, (i) the display controller is provided with the N controller circuits, the display controller arranged such that the N sets of image data respectively for N pixels are inputted at a time respectively via N routes (N is a whole number equal to or more than two), (ii) the N sets of image data are converted, by using the display controller, to the N sets of image data respectively for N screens, where the whole screen is divided into the N screens horizontally, and (iii) the N sets of image data is outputted to the display driving section via N×k routes (k is a whole number equal to or more than one). This method is arranged such that the image data respectively inputted into the respective controller circuits are mutually exchanged between the controller circuits. This makes it possible for each of the controller circuits to supply necessary image data to a driving display section for the screen, driving of which that controller circuit is in charge of controlling.

In this driving method, a memory capacity of the line memory provided in each of the controller circuits can be reduced to 1/N of the memory capacity necessary when the display controller is made of one controller circuit.

In the HDTV (1920×1080) display controller, as mentioned above, a memory capacity of the memory conventionally needs substantially two times a capacity of a memory for the XGA (1024×768). However, the driving method having the arrangement according to the present invention makes it possible to commonly use one type of display controller devices (such as LSI or the like) which constitutes one controller circuit, for low resolution (such as a case of XGA) and for high resolution (such as a case of HDTV). Namely, according to this arrangement, for low-resolution XGA the display control can be carried out by using one of the display controller devices of one type and (ii) for high-resolution HDTV, the display control can be carried out by using two of the display controller devices of one type.

Namely, according to the driving method mentioned above, the display controller device constituting the low resolution display controller can be used as the high resolution display controller. Therefore, it becomes possible to establish integration of display controllers for different resolutions, i.e. common use of a display controllers for different resolutions. The common use is advantageous costwise. Moreover, reducing price of the display apparatus can be realized.

Moreover, another display apparatus driving method of the present invention is a method, in which (i) one set of image data for one pixel is inputted at a time via one route, (ii) the one set of image data is converted, by a display controller, to N sets of image data respectively for N screens, where a whole screen is divided into the N screens horizontally, and (iii) the N sets of image data is outputted to a display driving section via N×k routes (N is a whole number equal to or more than two and k is a whole number equal to or more than one). In order to solve the problem mentioned above, the display apparatus driving method of the present invention is arranged such that the display controller includes N controller circuits connected to each other via a data bus or data buses and respectively including a line memory, wherein the N sets of image data are inputted into only one of the N controller circuits. In order to solve the problem mentioned above, the display apparatus driving method of the present invention is further arranged such that the one of the N controller circuit (i) stores a stay portion of the thus inputted image data into the line memory thereof, and converts the stay portion to an output image data, and (ii) transfers, via the data bus or data buses, a transfer portion of the thus inputted image data to another one of the N controller circuits which is in charge of controlling driving of a screen that the transfer portion is for, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling. Moreover, in order to solve the problem mentioned above, the display apparatus driving method of the present invention is further arranged such that each of the N controller circuits other than the one of the N controller circuits (i) stores, into the line memory thereof, the transfer portion transferred thereto, and (ii) converts the transfer portion into output image data. It is also preferable that each of the N controller circuits include an identical semiconductor chip.

In this method, the display controller is provided with the N controller circuits (N is a whole number equal to or more than two), the display controller arranged such that the one set of image data for one pixel is inputted at a time via one route, (ii) the one set of image data is converted, by the display controller, to the N sets of image data respectively for N screens, where the whole screen is divided into the N screens horizontally, and (iii) the N sets of image data is outputted to the display driving section via N×k routes (k is a whole number equal to or more than one). This method is arranged such that the image data respectively inputted into the respective controller circuits are mutually exchanged between the controller circuits. This makes it possible for each of the controller circuits to supply necessary image data to a driving display section for the screen, driving of which that controller circuit is in charge of controlling.

In this driving method, a memory capacity of the line memory provided in each of the controller circuits can be reduced to 1/N of the memory capacity necessary when the display controller is made of one controller circuit.

Accordingly, in the HDTV (1920×1080) display controller, as mentioned above, a memory capacity of the memory conventionally needs substantially two times a capacity of a memory for the XGA (1024×768). However, the driving method having the arrangement according to the present invention makes it possible to commonly use one type of display controller devices (such as LSI or the like) which constitutes one controller circuit, for low resolution (such as a case of XGA) and for high resolution (such as a case of HDTV). Namely, according to this arrangement, for low-resolution XGA the display control can be carried out by using one of the display controller devices of one type and (ii) for high-resolution HDTV, the display control can be carried out by using two of the display controller devices of one type.

Namely, according to the another driving method mentioned above, like the driving method previously mentioned, the display controller device constituting the low resolution display controller can be used as the high resolution display controller. Therefore, it becomes possible to establish integration of display controllers for different resolutions, i.e. common use of a display controllers for different resolutions. The common use is advantageous costwise. Moreover, reducing price of the display apparatus can be realized.

Furthermore, compared with the arrangement in which the N sets of the image data for N pixels are inputted at a time via N routes, the arrangement of the another driving method is such that the frequency becomes N times the frequency of the arrangement compared. However, because the input is carried out via one route, number of pins for interface connectors and number of connecting cables are reduced to 1/N of the arrangement in which the N sets of the image data for into N pixels are inputted at a time. Accordingly, merit such as cost reduction becomes possible.

A display apparatus of the present invention is a display apparatus, in which (i) N sets of image data respectively for N pixels are inputted at a time respectively via N routes (N is a whole number equal to or more than two), (ii) the N sets of image data are converted, by using a display controller, to N sets of image data respectively for N screens, where a whole screen is divided into the N screens horizontally, and (iii) the N sets of image data is outputted to a display driving section via N×k routes (k is a whole number equal to or more than one). In order to attain the object, the display apparatus of the present invention is arranged such that the display controller includes N controller circuits connected to each other via a data bus or data buses and respectively including a line memory; the display controller includes N controller circuits connected to each other via a data bus or data buses and respectively including a line memory, wherein the N sets of image data are inputted into the N controller circuits respectively via N routes; and each of the N controller circuits (i) transfers a transfer portion of the thus inputted image data via the data bus or data buses to another one of the N controller circuits that is in charge of controlling driving of a screen that the transfer portion is for, (ii) stores a stay portion of the thus received image data in its own line memory together with a transfer portion that is for the screen, driving of which that one of the N controller circuits is in charge of controlling and is transferred to that one of the N controller circuits, and (iii) converts, into output image data, the stay portion and transfer portion thus stored in its own line memory, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

Another display apparatus according to the present invention is a display apparatus, in which (i) one set of image data for one pixel is inputted at a time via one route, (ii) the one set of image data is converted, by using a display controller, to N sets of image data respectively for N screens, where a whole screen is divided into the N screens horizontally, and (iii) the N sets of image data is outputted to a display driving section via N×k routes (N is a whole number equal to or more than two and k is a whole number equal to or more than one). In order to attain the object the another display apparatus is arranged such that the display controller includes N controller circuits connected to each other via a data bus or data buses and respectively including a line memory; the N sets of image data are inputted into only one of the N controller circuits; the one of the N controller circuit (i) stores a stay portion of the thus inputted image data into the line memory thereof and converts the stay portion to an output image data, and (ii) transfers, via the data bus or data buses, a transfer portion of the thus inputted image data to another one of the N controller circuits which is in charge of controlling driving of a screen that the transfer portion is for, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling; and each of the N controller circuits other than the one of the N controller circuits (i) stores, into the line memory thereof, the transfer portion transferred thereto and (ii) converts the transfer portion into output image data.

As explained for the display apparatus driving methods, according to these arrangements of display apparatuses, the display controller device constituting the low resolution display controller can be used as the high resolution display controller. Therefore, it becomes possible to establish integration of display controllers for different resolutions, i.e. common use of a display controllers for different resolutions. The common use is advantageous costwise. Moreover, reducing price of the display apparatus can be realized.

The display apparatus of the present invention may be arranged such that one of the N controller circuits control driving of the other controller circuits.

As mentioned above, the image data is inputted into a controller circuit via a route that is for this controller circuit. As well as the image data, a controlling signal(s) such as a clock signal and/or the like is inputted therein. The each controller circuit acknowledges the corresponding screen, driving of which the each controller circuit is respectively in charge of controlling among N screens where a whole screen is divided into the N screens horizontally. The each controller circuit stores only the image data (i.e., stay portion of the image data) for the corresponding screen into the line memory of the controller circuit. On the other hand, the controller circuit transfers, to the another controller circuit, image data (i.e., transfer portion of the image data) other than the image data of the corresponding screen. Accordingly, each of the controller circuits is expected to drive the corresponding screen independently. However, in the reality, a problem such as a mistake in data sampling and the like may occur because the clock signal of each display controller signal may not be synchronized due to difference in length of each data transfer channel, production-derived uneven property between each display controller device constituting each of the controller circuits, or the other factor.

To deal with the problem mentioned above, it may be arranged that one of the N controller circuits control driving of the other controller circuits as mentioned above. With this, it becomes possible to avoid a problem due to difference in the length of the data transfer channel, production-derived uneven property between each display controller device constituting each of the controller circuits, or the other factor.

The display apparatus of the present invention may be arranged such that each of the N controller circuits perform the transfer of the image data to the another one of the N controller circuits in such a manner that each of the N controller circuits also transfers, to the another one of the N controller circuits, a display controlling signal inputted together with the image data, the display controlling signal including a clock signal.

As mentioned above, the image data is inputted into a controller circuit via a route that is for this controller circuit. As well as the image data, a controlling signal(s) such as a clock signal and/or the like is inputted therein. Because of this, each of the controller circuits may be so arranged as to store into the line memory the transferred image data in such a manner that the input of the transferred image data is synchronized with the clock signal included in the display controlling signal inputted directly into the controller circuit. However, in the reality, when the transferred image data is stored by synchronizing the image data to the clock signal included in the display controlling signal directly inputted, a problem may occur due to difference in the length of the data transfer channel, production-derived property unevenness between each display controller device constituting each of the controller circuits.

In order to solve this problem, it may be arranged that each of the N controller circuits perform the transfer of the image data to the another one of the N controller circuits in such a manner that each of the N controller circuits also transfers, to the another one of the N controller circuits, a display controlling signal inputted together with the image data, the display controlling signal including a clock signal. With this, the controller circuit can be arranged such that the one-line display is performed by exchanging the data each other among the N controller circuits, as mentioned above, because this makes it possible to avoid a problem due to difference in the length of the data transfer channel, production-derived uneven properties between each display controller device constituting each of the controller circuits, or the other factor.

In order to attain the object, the display apparatus may be arranged such that the data bus or each data bus is a duplex two-way data bus; the line memory is divided into memory regions independently controllable; the line memory stores the stay portion inputted directly and the transfer portion transferred thereto are respectively stored into the different memory regions; and the timing for starting the storage of the image data transferred is delayed by some clocks with respect to the storage of the image data directly inputted.

Because a bus for transmitting image data need a large number of lines, a scale of the controller circuit can be reduced to a large extent by using the duplex two-way data bus. However, when the two-way data bus is used, switchover of the bus directions takes time. Thus, missing (i.e. missing out of a part of the whole image data for one screen) may happen even if it is predetermined to switch a bus directions, for example, from a predetermined numbered pixel.

In order to solve the problem, it may be arranged that, as mentioned above, the line memory is divided into memory regions independently controllable; the line memory stores the stay portion inputted directly and the transfer portion transferred thereto are respectively stored into the different memory regions; and the timing for starting the storage of the image data transferred is delayed by some clocks with respect to the storage of the image data directly inputted. This makes it possible to assure time for the switchover of the two-way data bus, even when the one-line display is arranged to be performed by exchanging the data among N controller circuits via the two-way data bus. As the result, it becomes possible to avoid the problem due to the delay caused by the switchover of the bus directions.

In order to attain the object, a display controller device according to the present invention is arranged to include an input section for allowing image data at least to be inputted from outside; a data input-output section for allowing the image data at least to be exchanged mutually with another display controller device; first and second line memories, which have substantially same capacities, for storing the image data inputted from the input section or the data input-output section; and a controller section for controlling the input section, the data input-output section, and the first and the second line memories, the controlling section controlling the first and the second line memories in such a manner that the first and the second line memories alternatively carry out a storage operation and a reading operation of the image data for every one-line image data, the display controller device having a first mode and a second mode. The first mode is such that under the control of the controller section, the display controller device does not transfer the image data through the data input-output section, but stores the one-line image data inputted from the input section into the first line memory or the second line memory. The second mode is such that the image data is inputted into the display controller device through the input section via predetermined one of N routes (N is a whole number equal to or more than two); the display controller device transfers, via the data input-output section, a transfer portion of the thus inputted image data to the predetermined display controller device; and under the control of the control section, the display controller device stores, into the first line memory or the second line memory, a stay portion of the thus inputted image data and a transfer portion transferred thereto from another display controller device.

By arranging the display controller device in this way, the display controller device can be applied to both of the low resolution display controller and the high resolution display controller having an arrangement in which the N sets of image data for N pixels is inputted at a time via N routes. Accordingly, the display apparatus of the present invention as explained above and the driving method thereof can be realized easily.

Another display controller device of the present invention, in order to solve the problem mentioned above, is arranged to include an input section for allowing image data at least to be inputted from outside; a data input-output section for allowing the image data at least to be exchanged mutually with another display controller device; first and second line memories, which have substantially same capacities, for storing the image data inputted from the input section or the data input-output section; and a controller section for controlling the input section, the data input-output section, and the first and the second line memories, the controlling section controlling the first and the second line memories in such a manner that the first and the second line memories alternatively carry out a storage operation and a reading operation of the image data for every one-line image data, the display controller device having a first mode, a third mode, and a fourth mode. The first mode is such that under the control of the controller section, the display controller device does not transfer the image data through the data input-output section, but stores the one-line image data inputted from the input section into the first line memory or the second line memory. The third mode is such that the image data is inputted via the input section into the display controller section; under the control of the control section, the display controller device transfers, via the data input-output section, a transfer portion of the thus inputted image data to the predetermined display controller device; and under the control of the control section, the display controller device stores a stay portion of the thus inputted image data into the first line memory or the second line memory. The fourth mode is such that the image data is inputted via the input section into the display controller section; and under the control of the control section, the display controller device stores, into the first line memory or the second line memory, a transfer section transferred thereto via the data input-output section. Here, the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

By arranging the display controller device as mentioned above, the display controller device can be applied to the low resolution display controller and the high resolution display controller having an arrangement in which one set of the image data is inputted at a time. Accordingly, the display apparatus of the present invention and the driving method thereof can be easily realized.

Still another display controller device of the present invention, in order to solve the problem mentioned above, is arranged to include an input section for allowing image data at least to be inputted from outside; a data input-output section for allowing the image data at least to be exchanged mutually with another display controller device; first and second line memories, which have substantially same capacities, for storing the image data inputted from the input section or the data input-output section; and a controller section for controlling the input section, the data input-output section, and the first and the second line memories, the controlling section controlling the first and the second line memories in such a manner that the first and the second line memories alternatively carry out a storage operation and a reading operation of the image data for every one-line image data, the display controller device having a first mode, a second mode, a third mode, and a fourth mode. The first mode is such that under the control of the controller section, the display controller device does not transfer the image data through the data input-output section, but stores the one-line image data inputted from the input section into the first line memory or the second line memory. The second mode is such that the image data is inputted into the display controller device through the input section via predetermined one of N routes (N is a whole number equal to or more than two); the display controller device transfers, via the data input-output section, a transfer portion of the thus inputted image data to the predetermined display controller device; and under the control of the control section, the display controller device stores, into the first line memory or the second line memory, a stay portion of the thus inputted image data and a transfer portion transferred thereto from another display controller device. The third mode is such that the image data is inputted via the input section into the display controller section; under the control of the control section, the display controller device transfers, via the data input-output section, a transfer portion of the thus inputted image data to the predetermined display controller device; and under the control of the control section, the display controller device stores a stay portion of the thus inputted image data into the first line memory or the second line memory. The fourth mode is such that the image data is inputted via the input section into the display controller section; and under the control of the control section, the display controller device stores, into the first line memory or the second line memory, a transfer section transferred thereto via the data input-output section. Here, the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

By arranging the display controller device in this way; the display controller device can be applied to both of the low resolution display controller and the high resolution display controller having an arrangement in which the N sets of image data for N pixels are inputted at a time via N routes or one set of the image data is inputted for one pixel is inputted at a time via one system. Accordingly, the display apparatus of the present invention as explained above and the driving method thereof can be realized easily.

Yet another display controller device of the present invention, in order to solve the problem mentioned above, includes an input section for allowing image data at least to be inputted from outside; a data input-output section for allowing the image data at least to be exchanged mutually with another display controller device; first and second line memories, which have substantially same capacities, for storing the image data inputted from the input section or the data input-output section; and a controller section for controlling the input section, the first and the second line memories and the data input-output section, the display controller device having a first mode and a second mode. The first mode is for resolution that is attainable with image data whose amount is equal to or less than a capacity of each of the first and the second line memories, and the first mode is such that the controller section causes the first line memory and the second line memory to alternatively carry out a reading operation and a storing operation for every line, in such a manner that in a period in which one of the first line memory and the second line memory is performing the reading operation, the other one of the first line memory and the second line memory performs the storing operation, the reading operation being for reading out previous-line image data that has already been stored in the first line memory or the second line memory, and the storing operation being for storing, into the first line memory or the second line memory, one-line image data inputted via the input section. The second mode is for resolution that is attainable with image data whose amount is more than the capacity of each of the first line memory and the second line memory, and the second mode is such that: one of N sets of image data is inputted into the display controller device via the input section via one of N routes (N is a whole number equal to or more than two); the control section causes the display controller device to transfer, via the data input-output section, a transfer portion of thus inputted image data to a predetermined display controller device; the control section causes the display controller device to store, into the first line memory or the second line memory, a stay portion of the thus inputted image data and a transfer portion transferred thereto from the another display controller device; and the controller section causes the first line memory and the second line memory to alternatively carry out a reading operation and a storing operation for every line, the reading operation being for reading out previous-line image data that has already been stored in the first line memory or the second line memory, and the storing operation being for storing, into the first line memory or the second line memory, one-line image data inputted via the input section. Here, the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

By arranging the display controller device as mentioned above, the display apparatus and the driving method thereof can be easily realized.

Further another display controller device of the present invention, in order to solve the problem mentioned above, includes: an input section for allowing image data at least to be inputted from outside; a data input-output section for allowing the image data at least to be exchanged mutually with another display controller device; first and second line memories, which have substantially same capacities, for storing the image data inputted from the input section or the data input-output section; and a controller section for controlling the input section, the first and the second line memories and the data input-output section, the display controller device having a first mode and a second mode. The first mode is for resolution that is attainable with image data whose amount is equal to or less than a capacity of each of the first and the second line memories, and the first mode is such that the controller section causes the first line memory and the second line memory to alternatively carry out a reading operation and a storing operation for every line, in such a manner that in a period in which one of the first line memory and the second line memory is performing the reading operation, the other one of the first line memory and the second line memory performs the storing operation, the reading operation being for reading out previous-line image data that has already been stored in the first line memory or the second line memory, and the storing operation being for storing, into the first line memory or the second line memory, one-line image data inputted via the input section. The second mode is for resolution that is attainable with image data whose amount is more than the capacity of each of the first line memory and the second line memory, and the second mode is such that: one of two sets of image data respectively for odd pixels and even pixels is inputted into the display controller device via the input section via one of two routes; one of the first half portion and the second half portion of one-line image data thus inputted in the display controller device via the one of the two routes is transferred to another display controller device; another one of the first half portion and the second half portion is stored in the first line memory or the second line memory together with a counterpart of a first half portion and a second half portion of one-line image data inputted into the another display controller device via another one of the two route; another one of the first half portion and the second half portion; and the controller section causes the first line memory and the second line memory to alternatively carry out a reading operation and a storing operation for every line, the reading operation being for reading out previous-line image data that has already been stored in the first line memory or the second line memory, and the storing operation being for storing, into the first line memory or the second line memory, one-line image data inputted via the input section.

By arranging the display controller device as mentioned above, the display apparatus of the present invention and the driving method thereof can be easily realized.

These display controller devices of the present invention may be preferably arranged such that the controller section outputs, to the another display controller device, an operation controlling signal for controlling an operation of the data input-output section in the another display controller device according to a setting.

As explained above, even in the arrangement in which the one-line display is performed by exchanging the data each other among plural display controller devices, this arrangement makes it possible to avoid a problem due to difference in the length of the data transfer channel, production-derived uneven properties between each display controller device constituting each of the controller circuits, or the other factor.

These display controller devices of the present invention may be preferably arranged such that the controller section exchanges a display controlling signal with the another display controller device via the data input-output section, the display controlling signal inputted together with the image data and including a clock signal.

As explained above, even in the arrangement in which the one-line display is performed by exchanging the data each other among plural display controller devices, this arrangement makes it possible to avoid a problem due to difference in the length of the data transfer channel, production-derived uneven properties between each display controller device constituting each of the controller circuits, or the other factor.

These display controller devices of the present invention may be preferably arranged such that each of the first and the second line memories is divided into memory regions, which are independently controllable; and the first and the second line memories (i) store, respectively into the different memory regions, the stay portion inputted directly and the transfer portion transferred thereto and (ii) starts the storage of the image data transferred at some clocks after starting the storage of the image inputted directly.

As explained above, even in the arrangement in which the one-line display is performed by exchanging the data each other among plural display controller devices via the duplex two-way data bus(es), this arrangement makes it possible to avoid a problem due to difference in the length of the data transfer channel, production-derived uneven properties between each display controller device constituting each of the controller circuits, or the other factor.

A display apparatus of the present invention, in order to solve the problem mentioned above, includes: a display panel including plural signal lines, plural scanning lines, and plural pixels which are provided respectively with respect to intersections of the signal lines and the scanning lines and arranged in an array; a signal line driving circuit for driving the plural signal lines included in the display panel; a scanning line driving circuit for driving the plural scanning lines included in the display panel; and one display controller device, which has any one of the arrangements mentioned above.

Accordingly, because the display controller device is commonly useable for different resolutions, it becomes possible to reduce price of the display apparatus.

A display apparatus of the present invention, in order to solve the problem mentioned above, includes: a display panel including plural signal lines, plural scanning lines, and plural pixels which are provided respectively with respect to intersections of the signal lines and the scanning lines and arranged in an array; a signal line driving circuit for driving the plural signal lines included in the display panel; a scanning line driving circuit for driving the plural scanning lines included in the display panel; and plural display controller devices, which have any one of the arrangements mentioned above.

Accordingly, because the display controller device used is integrated among different resolutions, it becomes possible to reduce price of the display apparatus.

As mentioned above, a display apparatus driving method of the present invention is a method, in which (i) N sets of image data respectively for N pixels are inputted at a time respectively via N routes (N is a whole number equal to or more than two), (ii) the N sets of image data are converted, by a display controller, to N sets of image data respectively for N screens, where a whole screen is divided into the N screens horizontally, and (iii) the N sets of image data is outputted to a display driving section via N×k routes (k is a whole number equal to or more than one). The display apparatus driving method of the present invention is arranged such that the display controller includes N controller circuits connected to each other via a data bus or data buses and respectively including a line memory, wherein the N sets of image data are inputted into the N controller circuits respectively via N routes. The display apparatus driving method of the present invention is further arranged such that each of the N controller circuits (i) transfers a transfer portion of the thus inputted image data via the data bus or data buses to another one of the N controller circuits that is in charge of controlling driving of a screen that the transfer portion is for, (ii) stores a stay portion of the thus received image data in its own line memory together with a transfer portion that (a) is for the screen, driving of which that one of the N controller circuits is in charge of controlling and that (b) is transferred to that one of the N controller circuits, and (iii) converts, into output image data, the stay portion and transfer portion thus stored in its own line memory, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

As mentioned above, another display apparatus driving method of the present invention is a method, in which (i) one set of image data for one pixel is inputted at a time via one route, (ii) the one set of image data is converted, by a display controller, to N sets of image data respectively for N screens, where a whole screen is divided into the N screens horizontally, and (iii) the N sets of image data is outputted to a display driving section via N×k routes (N is a whole number equal to or more than two and k is a whole number equal to or more than one). The display apparatus driving method of the present invention is arranged such that the display controller includes N controller circuits connected to each other via a data bus or data buses and respectively including a line memory, wherein the N sets of image data are inputted into only one of the N controller circuits. The display apparatus driving method of the present invention is further arranged such that the one of the N controller circuit (i) stores a stay portion of the thus inputted image data into the line memory thereof and converts the stay portion to an output image data, and (ii) transfers, via the data bus or data buses, a transfer portion of the thus inputted image data to another one of the N controller circuits which is in charge of controlling driving of a screen that the transfer portion is for, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling. Moreover, the display apparatus driving method of the present invention is further arranged such that each of the N controller circuits other than the one of the N controller circuits (i) stores, into the line memory thereof, the transfer portion transferred thereto, and (ii) converts the transfer portion into output image data.

As mentioned above, a display apparatus of the present invention is a display apparatus, in which (i) N sets of image data respectively for N pixels are inputted at a time respectively via N routes (N is a whole number equal to or more than two), (ii) the N sets of image data are converted, by a display controller, to N sets of image data respectively for N screens, where a whole screen is divided into the N screens horizontally, and (iii) the N sets of image data is outputted to a display driving section via N×k routes (k is a whole number equal to or more than one). The display apparatus of the present invention is arranged such that the display controller includes N controller circuits connected to each other via a data bus or data buses and respectively including a line memory; the display controller includes N controller circuits connected to each other via a data bus or data buses and respectively including a line memory, wherein the N sets of image data are inputted into the N controller circuits respectively via N routes; and each of the N controller circuits (i) transfers a transfer portion of the thus inputted image data via the data bus or data buses to another one of the N controller circuits that is in charge of controlling driving of a screen that the transfer portion is for, (ii) stores a stay portion of the thus received image data in its own line memory together with a transfer portion that (a) is for the screen, driving of which that one of the N controller circuits is in charge of controlling and that (b) is transferred to that one of the N controller circuits, and (iii) converts, into output image data, the stay portion and transfer portion thus stored in its own line memory, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

As mentioned above, another display apparatus according to the present invention is a display apparatus, in which (i) one set of image data for one pixel is inputted at a time via one route, (ii) the one set of image data is converted, by a display controller, to N sets of image data respectively for N screens, where a whole screen is divided into the N screens horizontally, and (iii) the N sets of image data is outputted to a display driving section via N×k routes (N is a whole number equal to or more than two and k is a whole number equal to or more than one). The another display apparatus is arranged such that the display controller includes N controller circuits connected to each other via a data bus or data buses and respectively including a line memory; the N sets of image data are inputted into only one of the N controller circuits; the one of the N controller circuit (i) stores a stay portion of the thus inputted image data into the line memory thereof and converts the stay portion to an output image data, and (ii) transfers, via the data bus or data buses, a transfer portion of the thus inputted image data to another one of the N controller circuits which is in charge of controlling driving of a screen that the transfer portion is for, where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling; and each of the N controller circuits other than the one of the N controller circuits (i) stores, into the line memory thereof, the transfer portion transferred thereto and (ii) converts the transfer portion into output image data.

According to the method and the apparatus as mentioned above, a memory capacity of a line memory provide in the each controller circuit can be reduced to 1/N of a memory capacity necessary for arranging a display controller by one controller circuit. As mentioned above, a display controller in the HDTV (1920×1080) needs memory capacity of substantially two times memory capacity of a display controller for the XGA (1024×768) as the memory capacity of the line memory. However, these methods make it possible to commonly use one type of display controller devices (such as LSI or the like) which constitutes one controller circuit, for low resolution (such as a case of XGA) and for high resolution (such as a case of HDTV). Namely, according to these methods, for low-resolution XGA the display control can be carried out by using one of the display controller devices of one type and (ii) for high-resolution HDTV, the display control can be carried out by using two of the display controller devices of one type.

Namely, according to the driving methods as mentioned above, the display controller device constituting the low resolution display controller can be used as the high resolution display controller. Therefore, it becomes possible to establish integration of display controllers for different resolutions, i.e. common use of a display controllers for different resolutions. The common use is advantageous cost wise. Moreover, reducing price of the display apparatus can be realized.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display apparatus driving method, in which (i) N sets of image data respectively for N pixels are inputted at a time respectively via N routes (N is a whole number equal to or more than two), (ii) the N sets of image data are converted, by a display controller, to N sets of output image data respectively for N screens, where a whole screen is divided into the N screens horizontally, and (iii) the N sets of output image data are outputted to a display driving section via N×k routes (k is a whole number equal to or more than one), wherein:

the display controller includes N controller circuits connected to each other via a data bus or data buses and respectively including a line memory wherein the N sets of image data are inputted into the N controller circuits respectively via N routes; and each of the N controller circuits (i) transfers a transfer portion of the thus inputted image data via the data bus or data buses to another one of the N controller circuits that is in charge of controlling driving of another of the N screens that the transfer portion is for, (ii) stores a stay portion of the thus inputted image data in its own line memory together with another transfer portion that (a) is for one of the N screens, driving of which that one of the N controller circuits is in charge of controlling and that (b) is transferred to that one of the N controller circuits from another one of the N controller circuits, and (iii) converts, into output image data for that one of the N screens, the stay portion and the another transfer portion thus stored in its own line memory.

2. A display apparatus, in which (i) N sets of image data respectively for N pixels are inputted at a time respectively via N routes (N is a whole number equal to or more than two), (ii) the N sets of image data are converted, by a display controller, to N sets of output image data respectively for N screens, where a whole screen is divided into the N screens horizontally, and (iii) the N sets of output image data are outputted to a display driving section via N×k routes (k is a whole number equal to or more than one), wherein:

the display controller includes N controller circuits connected to each other via a data bus or data buses and respectively including a line memory, wherein the N sets of image data are inputted into the N controller circuits respectively via N routes; and each of the N controller circuits (i) transfers a transfer portion of the thus inputted image data via the data bus or data buses to another one of the N controller circuits that is in charge of controlling driving of another of the N screens that the transfer portion is for, (ii) stores a stay portion of the thus inputted image data in its own line memory together with another transfer portion that (a) is for one of the N screens, driving of which that one of the N controller circuits is in charge of controlling and (b) is transferred to that one of the N controller circuits from another one of the N controller circuits, and (iii) converts, into output image data for that one of the N screens, the stay portion and the another transfer portion thus stored in its own line memory.

3. The display apparatus as in claim 2, wherein:

one of the N controller circuits controls driving of the other controller circuits.

4. The display apparatus as in claim 2, wherein:

each of the N controller circuits performs the transfer of the image data to the another one of the N controller circuits in such a manner that each of the N controller circuits also transfers, to the another one of the N controller circuits, a display controlling signal inputted together with the image data, the display controlling signal including a clock signal.

5. The display apparatus as in claim 2, wherein:

the data bus or each data bus is a duplex two-way data bus;

the line memory is divided into memory regions independently controllable;

the line memory stores the stay portion inputted directly and the another transfer portion transferred thereto are respectively stored into the different memory regions; and the timing for starting the storage of the image data transferred is delayed by some clocks with respect to the storage of the image data directly inputted.

6. The display apparatus as in claim 2, wherein:

each of the N controller circuits includes an identical semiconductor chip.

7. A display controller device comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the data input-output section, and the first and the second line memories, the controller section controlling the first and the second line memories in such a manner that the first and the second line memories alternatively carry out a storage operation and a reading operation of the image data for every one-line image data, the display controller device having a first mode and a second mode, where the first mode is such that under the control of the controller section, the display controller device does not transfer the image data through the data input-output section, but stores the one-line image data inputted from the input section into the first line memory or the second line memory, where the second mode is such that the image data is inputted into the display controller device through the input section via predetermined one of N routes (N is a whole number equal to or more than two); the display controller device transfers, via the data input-output section, a transfer portion of the thus inputted image data to a predetermined display controller device; and under the control of the controller section, the display controller device stores, into the first line memory or the second line memory, a stay portion of the thus inputted image data and a transfer portion transferred thereto from another display controller device, and where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

8. The display controller device as in claim 7, wherein:

the controller section outputs, to the another display controller device, an operation controlling signal for controlling an operation of the data input-output section in the another display controller device according to a setting.

9. The display controller device as in claim 7, wherein:

the controller section exchanges a display controlling signal with the another display controller device via the data input-output section, the display controlling signal inputted together with the image data and including a clock signal.

10. The display controller device as in claim 7, wherein:

each of the first and the second line memories is divided into memory regions, which are independently controllable; and the first and the second line memories (i) store, respectively into the different memory regions, the stay portion inputted directly and the transfer portion transferred thereto and (ii) starts the storage of the image data transferred at some clocks after starting the storage of the image inputted directly.

11. A display controller device comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the data input-output section, and the first and the second line memories, the controller section controlling the first and the second line memories in such a manner that the first and the second line memories alternatively carry out a storage operation and a reading operation of the image data for every one-line image data, the display controller device having a first mode, a third mode, and a fourth mode, where the first mode is such that under the control of the controller section, the display controller device does not transfer the image data through the data input-output section but stores the one-line image data inputted from the input section into the first line memory or the second line memory, where the third mode is such that the image data is inputted via the input section into the display controller device; under the control of the controller section, the display controller device transfers, via the data input-output section, a transfer portion of the thus inputted image data to a predetermined display controller device; and under the control of the controller section, the display controller device stores a stay portion of the thus inputted image data into the first line memory or the second line memory, where the fourth mode is such that the image data is inputted via the data input-output section into the display controller device; and under the control of the controller section, the display controller device stores, into the first line memory or the second line memory, a transfer portion transferred thereto via the data input-output section, and where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

12. The display controller device as in claim 11, wherein:

the controller section outputs, to the another display controller device, an operation controlling signal for controlling an operation of the data input-output section in the another display controller device according to a setting.

13. The display controller device as in claim 11, wherein:

the controller section exchanges a display controlling signal with the another display controller device via the data input-output section, the display controlling signal inputted together with the image data and including a clock signal.

14. The display controller device as in claim 12, wherein:

each of the first and the second line memories is divided into memory regions, which are independently controllable; and the first and the second line memories (i) store, respectively into the different memory regions, the stay portion inputted directly and the transfer portion transferred thereto and (ii) starts the storage of the image data transferred at some clocks after starting the storage of the image inputted directly.

15. A display controller device comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the data input-output section, and the first and the second line memories, the controller section controlling the first and the second line memories in such a manner that the first and the second line memories alternatively carry out a storage operation and a reading operation of the image data for every one-line image data, the display controller device having a first mode, a second mode, a third mode, and a fourth mode, where the first mode is such that under the control of the controller section, the display controller device does not transfer the image data through the data input-output section, but stores the one-line image data inputted from the input section into the first line memory or the second line memory;

where the second mode is such that the image data is inputted into the display controller device through the input section via predetermined one of N routes (N is a whole number equal to or more than two); the display controller device transfers, via the data input-output section, a transfer portion of the thus inputted image data to a predetermined display controller device; and under the control of the controller section, the display controller device stores, into the first line memory or the second line memory, a stay portion of the thus inputted image data and a transfer portion transferred thereto from another display controller device, where the third mode is such that the image data is inputted via the input section into the display controller device; under the control of the controller section, the display controller device transfers, via the data input-output section, a transfer portion of the thus inputted image data to a predetermined display controller device; and under the control of the controller section, the display controller device stores a stay portion of the thus inputted image data into the first line memory or the second line memory, where the fourth mode is such that the image data is inputted via the data input-output section into the display controller device; and under the control of the controller section, the display controller device stores, into the first line memory or the second line memory, a transfer portion transferred thereto via the data input-output section, and where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

16. The display controller device as in claim 15, wherein:

the controller section outputs, to the another display controller device, an operation controlling signal for controlling an operation of the data input-output section in the another display controller device according to a setting.

17. The display controller device as in claim 15, wherein:

the controller section exchanges a display controlling signal with the another display controller device via the data input-output section, the display controlling signal inputted together with the image data and including a clock signal.

18. The display controller device as in claim 15, wherein:

each of the first and the second line memories is divided into memory regions, which are independently controllable; and the first and the second line memories (i) store, respectively into the different memory regions, the stay portion inputted directly and the transfer portion transferred thereto and (ii) starts the storage of the image data transferred at some clocks after starting the storage of the image inputted directly.

19. A display controller device comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the first and the second line memories and the data input-output section, the display controller device having a first mode and a second mode, where the first mode is for resolution that is attainable with image data whose amount is equal to or less than a capacity of each of the first and the second line memories, and the first mode is such that the controller section causes the first line memory and the second line memory to alternatively carry out a reading operation and a storing operation for every line, the reading operation being for reading out previous-line image data that has already been stored in the first line memory or the second line memory, and the storing operation being for storing, into the first line memory or the second line memory, one-line image data inputted via the input section, where the second mode is for resolution that is attainable with image data whose amount is more than the capacity of each of the first line memory and the second line memory, and the second mode is such that: one of N sets of image data is inputted into the display controller device via the input section via one of N routes (N is a whole number equal to or more than two); the controller section causes the display controller device to transfer, via the data input-output section, a transfer portion of thus inputted image data to a predetermined display controller device; the controller section causes the display controller device to store, into the first line memory or the second line memory, a stay portion of the thus inputted image data and a transfer portion transferred thereto from the another display controller device; and the controller section causes the first line memory and the second line memory to alternatively carry out a reading operation and a storing operation for every line, the reading operation being carried out in a period in which the display controller device performs storage of the stay portion and transfer of the transfer portion, the reading operation being for reading out previous-line image data that has already been stored in the first line memory or the second line memory, and the storing operation being for storing, into the first line memory or the second line memory a stay portion of the thus inputted image data inputted via the input section, and a transfer portion transferred thereto from the another display controller device via the data input-output section.

20. The display controller device as in claim 19, wherein:

the controller section outputs, to the another display controller device, an operation controlling signal for controlling an operation of the data input-output section in the another display controller device according to a setting.

21. The display controller device as in claim 19, wherein:

the controller section exchanges a display controlling signal with the another display controller device via the data input-output section, the display controlling signal inputted together with the image data and including a clock signal.

22. The display controller device as in claim 19, wherein:

each of the first and the second line memories is divided into memory regions, which are independently controllable; and the first and the second line memories (i) store, respectively into the different memory regions, the stay portion inputted directly and the transfer portion transferred thereto and (ii) starts the storage of the image data transferred at some clocks after starting the storage of the image inputted directly.

23. A display controller device comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the first and the second line memories and the data input-output section, the display controller device having a first mode and a second mode, where the first mode is for resolution that is attainable with image data whose amount is equal to or less than a capacity of each of the first and the second line memories, and the first mode is such that the controller section causes the first line memory and the second line memory to alternatively carry out a reading operation and a storing operation for every line, the reading operation being for reading out previous-line image data that has already been stored in the first line memory or the second line memory, and the storing operation being for storing, into the first line memory or the second line memory, one-line image data inputted via the input section, where the second mode is for resolution that is attainable with image data whose amount is more than the capacity of each of the first line memory and the second line memory, and the second mode is such that: one of two sets of image data respectively for odd pixels and even pixels is inputted into the display controller device via the input section; one of a first half portion and a second half portion of the thus inputted set of image data is transferred to another display controller device via the data input-output section; the remaining one of the first half portion and the second half portion is stored in the first line memory or the second line memory of the display controller device together with a counterpart first half portion or second half portion of one-line image data transferred from the another display controller device via the data input-output section; and the controller section causes the first line memory and the second line memory to alternatively carry out a reading operation and a storing operation for every line, the reading operation being carried out in a period where the display controller device performs storage and transfer of the thus inputted set of image data in the display controller device, the reading operation being for reading out previous-line image data that has already been stored in the first line memory or the second line memory, and the storing operation being for storing, into the first line memory or the second line memory, one-line image data including a half portion received via the input section and a half portion received via the data input-output section.

24. The display controller device as in claim 23, wherein:

the controller section outputs, to the another display controller device, an operation controlling signal for controlling an operation of the data input-output section in the another display controller device according to a setting.

25. The display controller device as in claim 23, wherein:

the controller section exchanges a display controlling signal with the another display controller device via the data input-output section, the display controlling signal inputted together with the image data and including a clock signal.

26. The display controller device as in claim 23, wherein:

each of the first and the second line memories is divided into memory regions, which are independently controllable; and the first and the second line memories (i) store, respectively into the different memory regions, the stay portion inputted directly and the transfer portion transferred thereto and (ii) starts the storage of the image data transferred at some clocks after starting the storage of the image inputted directly.

27. A display apparatus comprising:

a display panel including plural signal lines, plural scanning lines, and plural pixels which are provided respectively with respect to intersections of the signal lines and the scanning lines and arranged in an array;

a signal line driving circuit for driving the plural signal lines included in the display panel;

a scanning line driving circuit for driving the plural scanning lines included in the display panel; and one or plural display controller devices, the one or plural display controller devices comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the data input-output section, and the first and the second line memories, the controller section controlling the first and the second line memories in such a manner that the first and the second line memories alternatively carry out a storage operation and a reading operation of the image data for every one-line image data, the one or plural display controller devices having a first mode and a second mode, where the first mode is such that under the control of the controller section, the display controller device does not transfer the image data through the data input-output section, but stores the one-line image data inputted from the input section into the first line memory or the second line memory, and where the second mode is such that the image data is inputted into the display controller device through the input section via predetermined one of N routes (N is a whole number equal to or more than two); the display controller device transfers, via the data input-output section, a transfer portion of the thus inputted image data to a predetermined display controller device: and under the control of the controller section, the display controller device stores, into the first line memory or the second line memory, a stay portion of the thus inputted image data and a transfer portion transferred thereto from another display controller device, and where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

28. A display apparatus comprising:

a display panel including plural signal lines, plural scanning lines, and plural pixels which are provided respectively with respect to intersections of the signal lines and the scanning lines and arranged in an array;

a signal line driving circuit for driving the plural signal lines included in the display panel;

a scanning line driving circuit for driving the plural scanning lines included in the display panel; and one or plural display controller devices, the one or plural display controller devices comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the data input-output section, and the first and the second line memories, the controller section controlling the first and the second line memories in such a manner that the first and the second line memories alternatively carry out a storage operation and a reading operation of the image data for every one-line image data, the one or plural display controller devices having a first mode, a third mode, and a fourth mode, where the first mode is such that under the control of the controller section, the display controller device does not transfer the image data through the data input-output section, but stores the one-line image data inputted from the input section into the first line memory or the second line memory, where the third mode is such that the image data is inputted via the input section into the display controller device; under the control of the controller section, the display controller device transfers, via the data input-output section, a transfer portion of the thus inputted image data to a predetermined display controller device; and under the control of the controller section, the display controller device stores a stay portion of the thus inputted image data into the first line memory or the second line memory, where the fourth mode is such that the image data is inputted via the data input-output section into the display controller device; and under the control of the controller section, the display controller device stores, into the first line memory or the second line memory, a transfer portion transferred thereto via the data input-output section, and where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

29. A display apparatus comprising:

a display panel including plural signal lines, plural scanning lines, and plural pixels which are provided respectively with respect to intersections of the signal lines and the scanning lines and arranged in an array;

a signal line driving circuit for driving the plural signal lines included in the display panel;

a scanning line driving circuit for driving the plural scanning lines included in the display panel; and one or plural display controller devices, the one or plural display controller devices comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the data input-output section, and the first and the second line memories, the controlling section controlling the first and the second line memories in such a manner that the first and the second line memories alternatively carry out a storage operation and a reading operation of the image data for every one-line image data, the one of plural display controller devices having a first mode, a second mode, a third mode, and a fourth mode, where the first mode is such that under the control of the controller section, the display controller device does not transfer the image data through the data input-output section, but stores the one-line image data inputted from the input section into the first line memory or the second line memory;

where the second mode is such that the image data is inputted into the display controller device through the input section via predetermined one of N routes (N is a whole number equal to or more than two); the display controller device transfers, via the data input-output section, a transfer portion of the thus inputted image data to the predetermined display controller device; and under the control of the control section, the display controller device stores, into the first line memory or the second line memory, a stay portion of the thus inputted image data and a transfer portion transferred thereto from another display controller device, where the third mode is such that the image data is inputted via the input section into the display controller device; under the control of the controller section, the display controller device transfers, via the data input-output section, a transfer portion of the thus inputted image data to the predetermined display controller device; and under the control of the control section, the display controller device stores a stay portion of the thus inputted image data into the first line memory or the second line memory, where the fourth mode is such that the image data is inputted via the data input-output section into the display controller device; and under the control of the control section, the display controller device stores, into the first line memory or the second line memory, a transfer portion transferred thereto via the data input-output section, and where the stay portion is that portion of image data which is for a screen, driving of which a controller circuit that receives the image data is in charge of controlling and the transfer portion is that portion of image data which is for a screen other than the screen, driving of which the controller circuit that receives the image data is in charge of controlling.

30. A display apparatus comprising:

a display panel including plural signal lines, plural scanning lines, and plural pixels which are provided respectively with respect to intersections of the signal lines and the scanning lines and arranged in an array;

a signal line driving circuit for driving the plural signal lines included in the display panel;

a scanning line driving circuit for driving the plural scanning lines included in the display panel; and one or plural display controller devices, the one or plural display controller devices comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the first and the second line memories and the data input-output section, the one or plural display controller devices having a first mode and a second mode, where the first mode is for resolution that is attainable with image data whose amount is equal to or less than a capacity of each of the first and the second line memories, and the first mode is such that the controller section causes the first line memory and the second line memory to alternatively carry out a reading operation and a storing operation for every line, the reading operation being for reading out previous-line image data that has already been stored in the first line memory or the second line memory, and the storing operation being for storing, into the first line memory or the second line memory, one-line image data inputted via the input section, where the second mode is for resolution that is attainable with image data whose amount is more than the capacity of each of the first line memory and the second line memory, and the second mode is such that: one of N sets of image data is inputted into the display controller device via the input section via one of N routes (N is a whole number equal to or more than two); the controller section causes the display controller device to transfer, via the data input-output section, a transfer portion of thus inputted image data to a predetermined display controller device; the controller section causes the display controller device to store, into the first line memory or the second line memory, a stay portion of the thus inputted image data and a transfer portion transferred thereto from the another display controller device; and the controller section causes the first line memory and the second line memory to alternatively carry out a reading operation and a storing operation for every line, the reading operation being carried out in a period in which the display controller device performs storage of the stay portion and transfer of the transfer portion, the reading operation being for reading out previous-line image data that has already been stored in the first line memory or the second line memory, and the storing operation being for storing, into the first line memory or the second line memory, a stay portion of the thus inputted image data inputted via the input section, and a transfer portion transferred thereto from the another display controller device via the data input-output section.

31. A display apparatus comprising:

a display panel including plural signal lines, plural scanning lines, and plural pixels which are provided respectively with respect to intersections of the signal lines and the scanning lines and arranged in an array;

a signal line driving circuit for driving the plural signal lines included in the display panel;

a scanning line driving circuit for driving the plural scanning lines included in the display panel; and one or plural display controller devices, the one or plural display controller devices comprising:

an input section for allowing image data at least to be inputted from outside;

a data input-output section for allowing the image data at least to be exchanged mutually with another display controller device;

first and second line memories, which have substantially same capacities, for storing the image data inputted from the input section or the data input-output section; and a controller section for controlling the input section, the first and the second line memories and the data input-output section, the one or plural display controller devices having a first mode and a second mode, where the first mode is for resolution that is attainable with image data whose amount is equal to or less than a capacity of each of the first and the second line memories, and the first mode is such that the controller section causes the first line memory and the second line memory to alternatively carry out a reading operation and a storing operation for every line, the reading operation being for reading out previous-line image data that has already been stored in the first line memory or the second line memory, and the storing operation being for storing, into the first line memory or the second line memory, one-line image data inputted via the input section, and where the second mode is for resolution that is attainable with image data whose amount is more than the capacity of each of the first line memory and the second line memory, and the second mode is such that: one of two sets of image data respectively for odd pixels and even pixels is inputted into the display controller device via the input section; one of a first half portion and a second half portion of the thus inputted set of image data is transferred to another display controller device via the data input-output section; the remaining one of the first half portion and the second half portion is stored in the first line memory or the second line memory of the display controller device together with a counterpart first half portion or second half portion of one-line image data transferred from the another display controller device via the data input-output section; and the controller section causes the first line memory and the second line memory to alternatively carry out a reading operation and a storing operation for every line, the reading operation being carried out in a period where the display controller device performs storage and transfer of the thus inputted set of image data in the display controller device, the reading operation being for reading out previous-line image data that has already been stored in the first line memory or the second line memory, and the storing operation being for storing, into the first line memory or the second line memory, one-line image data including a half portion received via the input section and a half portion received via the data input-output section.

* * * * *